US008239986B2

(12) United States Patent
Heimbrock et al.

(10) Patent No.: US 8,239,986 B2
(45) Date of Patent: Aug. 14, 2012

(54) SIDERAIL ASSEMBLY FOR A PATIENT-SUPPORT APPARATUS

(75) Inventors: Richard H. Heimbrock, Cincinnati, OH (US); David W. Hornbach, Brookville, IN (US); Brian T. Wiggins, Burlington, KY (US); Darrell L. Metz, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 596 days.

(21) Appl. No.: 12/403,724

(22) Filed: Mar. 13, 2009

(65) Prior Publication Data

US 2009/0229051 A1 Sep. 17, 2009

Related U.S. Application Data

(60) Provisional application No. 61/069,273, filed on Mar. 13, 2008.

(51) Int. Cl.
*A47C 21/08* (2006.01)

(52) U.S. Cl. ..... 5/430; 5/428; 5/425

(58) Field of Classification Search ..... 5/430, 424–429, 5/100

See application file for complete search history.

(56) References Cited

U.S. PATENT DOCUMENTS

| | | | |
|---|---|---|---|
| 412,356 | A | 10/1889 | Zerfas et al. |
| 421,656 | A | 2/1890 | Blanken |
| 1,398,203 | A | 11/1921 | Schmidt |
| 1,824,866 | A | 9/1931 | Bristol |
| 2,136,088 | A | 11/1938 | Stevens, Sr. |
| 2,164,484 | A | 7/1939 | Wolfe |
| 2,587,291 | A | 2/1952 | Rochers |
| 2,710,976 | A | 6/1955 | Martensen |
| 2,722,017 | A | 11/1955 | Burst et al. |
| 2,734,104 | A | 2/1956 | Gollhofer |
| 2,766,463 | A | 10/1956 | Bendersky |
| 2,817,854 | A | 12/1957 | Pratt |
| 2,817,855 | A | 12/1957 | Pratt |
| 2,951,252 | A | 9/1960 | Roche |
| 3,010,121 | A | 11/1961 | Breach |
| 3,018,492 | A | 1/1962 | Rosen |
| 3,021,534 | A | 2/1962 | Hausted |
| 3,053,568 | A | 9/1962 | Miller |
| 3,055,020 | A | 9/1962 | Mann |
| 3,104,402 | A | 9/1963 | Johnson |
| 3,112,500 | A | 12/1963 | MacDonald |
| 3,138,805 | A | 6/1964 | Piazza |
| 3,197,852 | A | 8/1965 | Johnson |
| 3,234,570 | A | 2/1966 | Hutt |
| 3,249,387 | A | 5/1966 | Pivacek |
| 3,256,633 | A | 6/1966 | Michelsen |

(Continued)

FOREIGN PATENT DOCUMENTS

| | | |
|---|---|---|
| CA | 915354 | 11/1972 |

(Continued)

*Primary Examiner* — Robert G Santos
(74) *Attorney, Agent, or Firm* — Barnes & Thornburg LLP

(57) ABSTRACT

A siderail assembly includes a frame, a link mechanism coupled to the frame and movable between first and second positions, and a panel coupled to the linkage and movable therewith between a first position and a second position. The link mechanism is configured to provide compound motion such that the siderail panel follows specific path. The siderail may include electronic controls to limit the movement of the linkage based on the position of the siderail assembly and various portions of a patient-support apparatus on which the siderail may be positioned.

20 Claims, 20 Drawing Sheets

FIG. 28

U.S. PATENT DOCUMENTS

| | | | |
|---|---|---|---|
| 3,321,779 | A | 5/1967 | Kaufman et al. |
| 3,344,445 | A | 10/1967 | Crawford |
| 3,351,962 | A | 11/1967 | Dodrill et al. |
| 3,486,176 | A | 12/1969 | Murcott |
| 3,506,989 | A | 4/1970 | Ross et al. |
| 3,526,008 | A | 9/1970 | Pruim |
| 3,585,659 | A | 6/1971 | Burst et al. |
| 3,590,403 | A | 7/1971 | Mixon |
| 3,619,824 | A | 11/1971 | Doyle |
| 3,640,566 | A | 2/1972 | Hodge |
| 3,742,530 | A | 7/1973 | Clark |
| 3,806,109 | A | 4/1974 | Weber et al. |
| 3,845,511 | A | 11/1974 | Benoit et al. |
| 3,865,434 | A | 2/1975 | Sully |
| 3,877,090 | A | 4/1975 | Schutz |
| 3,893,197 | A | 7/1975 | Ricke |
| 3,897,973 | A | 8/1975 | Long et al. |
| 3,905,591 | A | 9/1975 | Schorr et al. |
| 3,932,903 | A | 1/1976 | Adams et al. |
| 3,971,083 | A | 7/1976 | Peterson |
| 4,103,376 | A | 8/1978 | Benoit et al. |
| 4,142,259 | A | 3/1979 | Moore |
| 4,168,099 | A | 9/1979 | Jacobs |
| 4,183,015 | A | 1/1980 | Drew et al. |
| 4,186,456 | A | 2/1980 | Huempfner |
| 4,214,326 | A | 7/1980 | Spann |
| 4,215,446 | A | 8/1980 | Mahoney |
| 4,231,030 | A | 10/1980 | Weiss |
| 4,232,415 | A | 11/1980 | Webber |
| 4,362,328 | A | 12/1982 | Tacheny et al. |
| 4,370,765 | A | 2/1983 | Webber |
| 4,409,695 | A | 10/1983 | Johnston et al. |
| 4,435,862 | A | 3/1984 | King et al. |
| 4,439,880 | A | 4/1984 | Koncelik et al. |
| 4,453,732 | A | 6/1984 | Assanah et al. |
| 4,484,367 | A | 11/1984 | Jenkins |
| 4,525,885 | A | 7/1985 | Hunt et al. |
| 4,607,402 | A | 8/1986 | Pollard |
| 4,612,679 | A | 9/1986 | Mitchell |
| 4,653,129 | A | 3/1987 | Kuck et al. |
| 4,670,923 | A | 6/1987 | Gabriel et al. |
| 4,672,698 | A | 6/1987 | Sands |
| 4,676,687 | A | 6/1987 | Koffler |
| 4,680,790 | A | 7/1987 | Packard et al. |
| 4,685,159 | A | 8/1987 | Oetiker |
| 4,704,750 | A | 11/1987 | Wheelock |
| 4,710,049 | A | 12/1987 | Chang |
| 4,745,647 | A | 5/1988 | Goodwin |
| 4,747,171 | A | 5/1988 | Einsele et al. |
| 4,752,977 | A | 6/1988 | Smith et al. |
| 4,767,419 | A | 8/1988 | Fattore |
| 4,783,864 | A | 11/1988 | Turner |
| 4,827,545 | A | 5/1989 | Arp |
| 4,858,260 | A | 8/1989 | Failor et al. |
| 4,872,228 | A | 10/1989 | Bishop |
| 4,894,876 | A | 1/1990 | Fenwick |
| 4,912,787 | A | 4/1990 | Bradcovich |
| 4,951,032 | A | 8/1990 | Langsam |
| 4,985,946 | A | 1/1991 | Foster et al. |
| 4,987,623 | A | 1/1991 | Stryker et al. |
| 4,993,089 | A | 2/1991 | Solomon et al. |
| 4,998,939 | A | 3/1991 | Potthast et al. |
| 5,010,611 | A | 4/1991 | Mallett |
| 5,035,014 | A | 7/1991 | Blanchard |
| 5,040,253 | A | 8/1991 | Cheng |
| 5,044,025 | A | 9/1991 | Hunsinger et al. |
| 5,060,327 | A | 10/1991 | Celestina et al. |
| 5,072,463 | A | 12/1991 | Willis |
| 5,077,843 | A | 1/1992 | Dale et al. |
| 5,083,332 | A | 1/1992 | Foster et al. |
| 5,083,334 | A | 1/1992 | Huck et al. |
| 5,084,925 | A | 2/1992 | Cook |
| 5,097,550 | A | 3/1992 | Marra, Jr. |
| 5,121,756 | A | 6/1992 | Koledin |
| 5,129,117 | A | 7/1992 | Celestina et al. |
| 5,175,897 | A | 1/1993 | Marra, Jr. |
| 5,179,744 | A | 1/1993 | Foster et al. |
| 5,187,824 | A | 2/1993 | Stryker |
| 5,191,663 | A | 3/1993 | Holder et al. |
| 5,193,633 | A | 3/1993 | Ezenwa |
| 5,197,156 | A | 3/1993 | Stryker et al. |
| D336,577 | S | 6/1993 | Celestina et al. |
| 5,216,768 | A | 6/1993 | Bodine et al. |
| 5,222,132 | A | 6/1993 | Rioux, Jr. |
| 5,230,113 | A | 7/1993 | Foster et al. |
| 5,235,258 | A | 8/1993 | Schuerch |
| 5,279,010 | A | 1/1994 | Ferrand et al. |
| 5,317,769 | A | 6/1994 | Weismiller et al. |
| 5,365,623 | A | 11/1994 | Springer |
| 5,370,111 | A | 12/1994 | Reeder et al. |
| 5,377,370 | A | 1/1995 | Foster et al. |
| 5,381,571 | A | 1/1995 | Gabhart |
| 5,384,927 | A | 1/1995 | Mardero et al. |
| 5,394,580 | A | 3/1995 | Foster et al. |
| 5,410,765 | A | 5/1995 | Youngblood |
| 5,418,988 | A | 5/1995 | Iura |
| 5,421,046 | A | 6/1995 | Vande Streek |
| 5,450,641 | A | 9/1995 | Montgomery |
| 5,454,126 | A | 10/1995 | Foster et al. |
| 5,461,673 | A | 10/1995 | Coons |
| 5,479,666 | A | 1/1996 | Foster et al. |
| 5,481,772 | A | 1/1996 | Glynn et al. |
| 5,485,699 | A | 1/1996 | Gabhart |
| 5,511,257 | A | 4/1996 | Hannes |
| 5,522,100 | A | 6/1996 | Schilling et al. |
| 5,524,306 | A | 6/1996 | George |
| 5,542,135 | A | 8/1996 | Ozrovitz et al. |
| 5,542,136 | A | 8/1996 | Tappel |
| 5,542,138 | A | 8/1996 | Williams et al. |
| 5,557,817 | A | 9/1996 | Haddock |
| 5,577,277 | A | 11/1996 | Sundberg et al. |
| 5,586,346 | A | 12/1996 | Stacy et al. |
| 5,625,913 | A | 5/1997 | Singleton |
| 5,671,490 | A | 9/1997 | Wu |
| 5,678,267 | A | 10/1997 | Kinder |
| 5,689,839 | A | 11/1997 | Laganiere et al. |
| 5,715,548 | A | 2/1998 | Weismiller et al. |
| 5,732,423 | A | 3/1998 | Weismiller et al. |
| 5,737,781 | A | 4/1998 | Votel |
| 5,749,112 | A | 5/1998 | Metzler |
| 5,761,756 | A | 6/1998 | Nowak et al. |
| 5,781,945 | A | 7/1998 | Scherer et al. |
| 5,802,636 | A | 9/1998 | Corbin et al. |
| 5,802,640 | A | 9/1998 | Ferrand et al. |
| 5,832,549 | A | 11/1998 | Le Pallec et al. |
| 5,864,900 | A | 2/1999 | Landau |
| 5,878,452 | A | 3/1999 | Brooke et al. |
| 5,926,873 | A | 7/1999 | Fountain |
| 5,940,910 | A | 8/1999 | Weismiller et al. |
| 5,975,592 | A | 11/1999 | Lin |
| 6,008,598 | A | 12/1999 | Luff et al. |
| 6,021,533 | A | 2/2000 | Ellis et al. |
| 6,038,721 | A | 3/2000 | Gordon |
| 6,058,531 | A | 5/2000 | Carroll |
| 6,182,310 | B1 | 2/2001 | Weismiller et al. |
| 6,240,580 | B1 | 6/2001 | Hamilton et al. |
| 6,253,397 | B1 | 7/2001 | Bartow et al. |
| 6,347,422 | B2 | 2/2002 | Heavrin |
| 6,360,385 | B1 | 3/2002 | Lewandowski |
| 6,363,552 | B1 | 4/2002 | Hornbach et al. |
| 6,374,440 | B1 | 4/2002 | Thim, Jr. |
| 6,397,416 | B2 | 6/2002 | Brooke et al. |
| 6,401,277 | B1 | 6/2002 | Savage et al. |
| 6,412,126 | B2 | 7/2002 | Heimbrock et al. |
| 6,427,264 | B1 | 8/2002 | Metz et al. |
| 6,446,283 | B1 | 9/2002 | Heimbrock et al. |
| 6,615,426 | B1 | 9/2003 | Risk, Jr. |
| 6,622,364 | B2 | 9/2003 | Hamilton et al. |
| 6,640,360 | B2 | 11/2003 | Hornbach et al. |
| 6,640,361 | B2 | 11/2003 | Heimbrock et al. |
| 6,662,391 | B2 | 12/2003 | Wilson et al. |
| 6,691,346 | B2 | 2/2004 | Osborne et al. |
| 6,751,815 | B2 | 6/2004 | Heimbrock et al. |
| 6,779,209 | B2 | 8/2004 | Ganance |
| 6,820,293 | B2 | 11/2004 | Alverson |
| 6,829,793 | B2 | 12/2004 | Brooke et al. |
| 6,851,142 | B2 | 2/2005 | Stryker et al. |

| | | | |
|---|---|---|---|
| 6,928,673 | B2 | 8/2005 | Risk, Jr. |
| 6,938,289 | B2 | 9/2005 | Morin |
| 7,007,323 | B2 | 3/2006 | Zerhusen et al. |
| 7,073,220 | B2 | 7/2006 | Simmonds et al. |
| 7,082,630 | B2 | 8/2006 | Castonguay et al. |
| 7,107,636 | B2 | 9/2006 | Metz et al. |
| 7,107,637 | B2 | 9/2006 | Kuek et al. |
| 7,237,288 | B2 | 7/2007 | Lemire et al. |
| 7,293,305 | B2 | 11/2007 | Metz et al. |
| 7,430,771 | B2 | 10/2008 | Heimbrock |
| 7,543,583 | B2 | 6/2009 | Acton |
| 7,712,165 | B2 | 5/2010 | Guguin |
| 7,712,166 | B2 | 5/2010 | Stryker et al. |
| 7,712,167 | B2 | 5/2010 | Guguin et al. |
| 7,761,939 | B2 | 7/2010 | Wiggins et al. |
| 7,784,125 | B2 | 8/2010 | Morin et al. |
| 7,788,747 | B2 | 9/2010 | Kramer et al. |
| 7,793,369 | B2 | 9/2010 | Guguin et al. |
| 7,805,782 | B2 | 10/2010 | Hakamiun et al. |
| 7,814,588 | B2 | 10/2010 | Guguin et al. |
| 2003/0019035 | A1 | 1/2003 | Heimbrock et al. |
| 2004/0025253 | A1 | 2/2004 | Heimbrock et al. |
| 2004/0158923 | A1 | 8/2004 | Perez et al. |
| 2004/0177443 | A1 | 9/2004 | Simmonds et al. |
| 2007/0180616 | A1 | 8/2007 | Newkirk et al. |
| 2007/0180624 | A1 | 8/2007 | Newkirk et al. |
| 2009/0007334 | A1 | 1/2009 | Stryker et al. |
| 2009/0229050 | A1 | 9/2009 | Heimbrock |
| 2009/0229051 | A1 | 9/2009 | Heimbrock et al. |
| 2009/0249548 | A1 | 10/2009 | Hensley et al. |
| 2011/0219541 | A1* | 9/2011 | Jacobs et al. ..... 5/430 |

FOREIGN PATENT DOCUMENTS

| | | |
|---|---|---|
| CA | 2457327 | 11/2004 |
| CA | 2492765 | 5/2009 |
| DE | 19900602 | 7/2000 |
| EP | 1108410 | 6/2001 |
| EP | 1281381 | 2/2003 |
| EP | 1295583 | 3/2003 |
| EP | 1721550 | 11/2006 |
| EP | 2100578 | 9/2009 |
| EP | 2100579 | 9/2009 |
| FR | 999408 | 1/1952 |
| WO | 9817153 | 4/1998 |
| WO | 0007537 | 2/2000 |
| WO | 0069386 | 11/2000 |
| WO | 0147340 | 7/2001 |
| WO | 0162151 | 8/2001 |
| WO | 0170163 | 9/2001 |
| WO | 03070061 | 8/2003 |
| WO | 2005092153 | 10/2005 |

* cited by examiner 600
602
604
614
624
616
620
610
626
606
618
660
612
664
634
630
646
650
652
640
636
642
662
638
656
658
608
648
Y 664
672
652
670
646
636
642
668
Y 656
664
672
670
650
646
640
668
636
Y 656
662
672
652
670
646
636
642
668
Y 656
670
648
658
672
638
668
636
646
Y

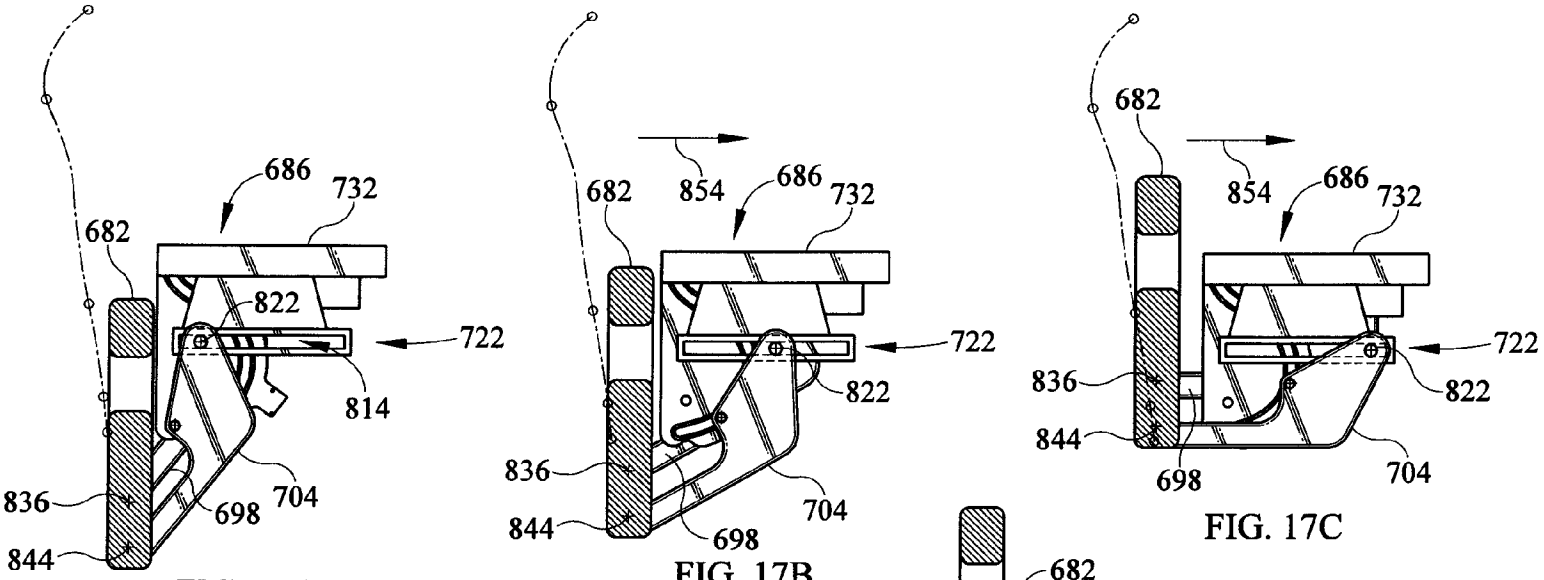
FIG. 17A
FIG. 17B
FIG. 17C
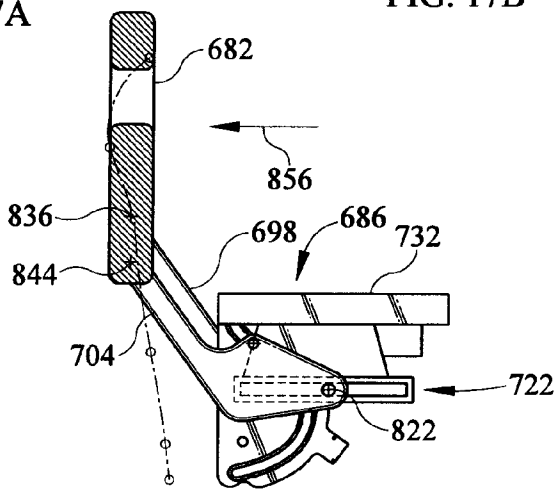
FIG. 17D
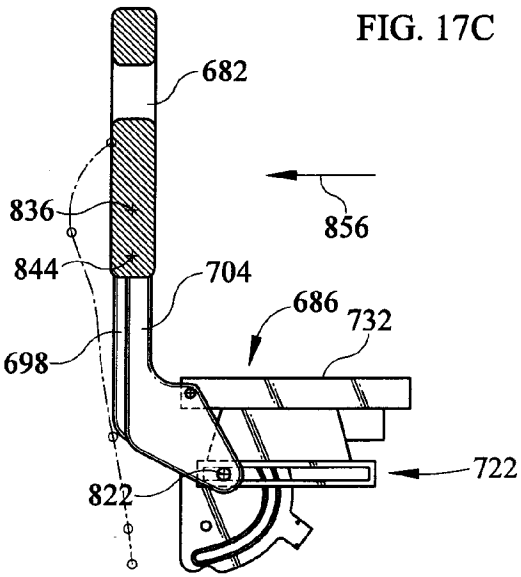
FIG. 17E

SIDERAIL ASSEMBLY FOR A PATIENT-SUPPORT APPARATUS

This application claims priority under 35 U.S.C. §119(e) to U.S. Provisional Application Ser. No. 61/069,273, filed Mar. 13, 2008, which is expressly incorporated herein by reference hereto.

BACKGROUND OF THE INVENTION

The present disclosure is related to a patient-support apparatus including at least one siderail. More specifically, the present disclosure is related to siderails with motion control linkages to control the movement of the siderail between raised and lowered positions.

A siderail assembly may be configured to allow positioning of the siderail assembly between at least one lowered position providing improved caregiver access to the patient, and at least one raised position. The kinematic structure of a siderail may result in the movement of the siderail assembly to cause the siderail to interfere with obstructions as it transfers between a raised position and a lowered position. Obstructions may include a patient-support surface supported by the patient-support apparatus, walls, furniture, and other adjacent patient-support apparatuses that may be positioned for reasons, such as, for example, transferring a patient between patient-support apparatuses.

SUMMARY OF THE INVENTION

This application discloses one or more of the features recited in the appended claims and/or the following features which, alone or in any combination, may comprise patentable subject matter:

In one aspect of the present disclosure, a siderail assembly for a patient-support apparatus comprises, a barrier; a support pivotably coupled to the barrier about a first generally horizontal axis and a guide pivotably coupled to the support. The guide is pivotably coupled to the support such that the support is pivotable about a second axis generally parallel to the first axis and a third axis spaced apart from the second axis, the third axis generally parallel to the first axis. The guide is configured to allow the second axis to move along a first path with respect to at least a portion of the guide and allow the third axis to move along a second path with respect to at least a portion of the guide, the second path different from the first path.

In some embodiments, a portion of the first path includes a vertical component. In some embodiments, a portion of the second path includes a horizontal component. In some embodiments, the shape of the first path is substantially similar to the shape of the second path.

The guide may include a first track and a second track. In some embodiments, the siderail assembly further comprises a first follower engaged with the first track and configured to traverse at least a portion of the first track and a second follower engaged with the second track and configured to traverse at least a portion of the second track.

The support may further include a first link pivotably coupled with the barrier for movement about the first axis, pivotably coupled with the guide for movement about the second axis, and pivotably coupled with the guide for movement about the third axis. Additionally, the support may further include a second link pivotably coupled with the barrier for movement about a fourth axis generally parallel to the first axis, and pivotably coupled with the guide for movement about a fifth axis generally parallel to the first axis.

In another aspect of the disclosure, a siderail assembly comprises a frame, a link mechanism coupled to the frame and movable between first and second positions, a drive coupled to the frame and coupled to the link mechanism, and a panel coupled to the linkage and movable therewith between a first position and a second position. The drive includes an extensible rod which acts on the linkage to move the linkage between first and second positions. In some embodiments, the link mechanism includes a drive arm assembly pivotably coupled to the frame, a drive link pivotably coupled to the drive arm assembly and pivotably coupled to a carriage, and the carriage is movable relative to the frame. The carriage may translate relative to the frame. In some embodiments the frame includes a pair of rails and the carriage translates along the rails. The link mechanism may include a guide link pivotably coupled to the carriage. The guide link may be pivotably coupled to the panel. Also, the drive link may be coupled to the panel.

In still another aspect of the disclosure, a siderail assembly for a patient-support apparatus comprises a frame, a link mechanism coupled to the frame and movable between first and second positions, an adjustable stop coupled to the frame, and a panel coupled to the linkage and movable therewith between a first position and a second position. The adjustable stop includes an extensible rod and a stop pin coupled to the extensible rod, the stop pin positioned to engage the link mechanism to limit a range of travel of the link mechanism, the adjustable stop configured to extend and retract the extensible rod to vary the position of the stop pin.

In yet another aspect, a siderail assembly may further comprise a limit switch coupled to the linkage mechanism and operable to determine that the linkage mechanism is in a second position. The limit switch may be configured to send a signal to a controller to limit the travel of a portion of a patient-support assembly.

In some embodiments, the adjustable stop comprises a solenoid operable to extend the stop pin into position to engage the link mechanism. In other embodiments, the adjustable stop comprises an actuator operable to vary the position of the stop pin such that the travel of the link mechanism may be limited to any of a number of positions.

Additional features alone or in combination with any other feature(s), including those listed above and those listed in the claims and those described in detail below, may comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which:

FIGS. 17A, 17B, 17C, 17D, and 17E are sectional views of the siderail assembly of FIG. 16, taken along line 17-17, showing the siderail assembly in the first, second, third, fourth and fifth positions, respectively;

DETAILED DESCRIPTION OF THE DRAWINGS

Figure 1:
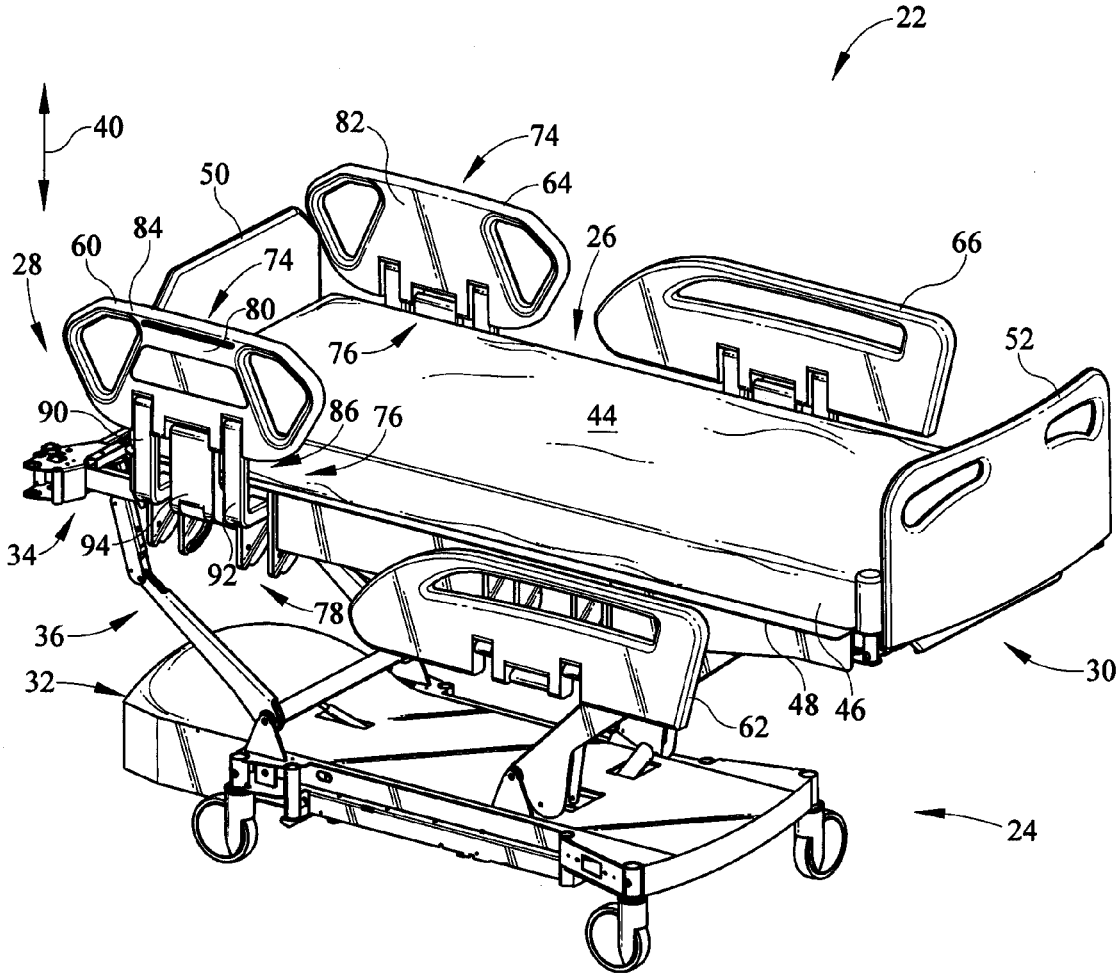
FIG. 1 is a perspective view of a patient-support apparatus including four siderails coupled to a frame by a guide assembly and a support assembly.

A patient-support apparatus illustratively embodied as a hospital bed 22 includes a frame 24 and a patient-support surface 26 illustratively embodied as a mattress 26 as shown in FIG. 1. Frame 24 defines a head end 28, and a foot end 30 spaced apart therefrom. Frame 24, also includes a base 32 and an upper frame 34 coupled to base 32 by a lift assembly 36. Lift assembly 36 raises and lowers upper frame 34 relative to base 32 along an axis 40. Frame 24 may further include a bed controller (not shown) operatively coupled to the lift assembly 36 to control vertical movement of upper frame 34.

The mattress 26, includes a top surface 44, a bottom surface (not shown), and a perimeter surface 46. The upper frame 34 of frame 24 includes a support deck 48 that engages the bottom surface of mattress 26. While the patient-support apparatus in the present embodiment is illustratively shown as hospital bed 22, a patient-support apparatus may also include other apparatus for supporting a patient such as beds of varying types, such as, for example, birthing beds, stretchers, bariatric beds, and tables of varying types, such as operating room tables, diagnostic tables, and examination tables. Additionally, while not shown, a patient-support apparatus may also include apparatuses with features not shown, such as, for example, therapy features, patient positioning features, patient handling features, and equipment interface features.

In a first embodiment, shown in FIG. 1, hospital bed 22 includes an end panel 52 oriented at foot end 30 and an end panel 50 oriented at head end 28. Hospital bed 22 includes four siderail assemblies shown coupled to frame 24: a right head siderail assembly 60, a right foot siderail assembly 62, a left head siderail assembly 64, and a left foot siderail assembly 66. Siderail assemblies 60-66 may be movable between a raised position as right head siderail assembly 60 is shown in FIG. 1, and a lowered position, as right foot siderail assembly 62 is shown in FIG. 1

Right head siderail assembly 60 and left head siderail assembly 64 each include a barrier, panel 74, a support assembly embodied as link mechanism 76, and a guide assembly embodied as guide mechanism 78. Panel 74 includes an outward side 80 facing away from frame 24, an inward side 82 facing opposite outward side 80, a top portion 84 extending in an upward direction away from frame 24, and a bottom portion 86 extending opposite of top portion 84.

Link mechanism 76 illustratively includes a first upper link 90, a second upper link 92 and a lower link 94, as shown in FIG. 1. Links 90-94 are pivotably coupled to panel 74, and are configured to pivot between a raised position and a lowered position with respect to frame 24, and subsequently allow a barrier to move between a raised and a lower position. While upper links 90, 92 are illustratively shown as the outer links and lower link 94 is illustratively shown as the center link, a support assembly may include one or more upper links, and one or more lower links. Furthermore, it is within the scope of the present disclosure for a support assembly to include an upper link positioned as a center or inner link and a lower link to be positioned as an outer link.

Guide mechanism 78 is coupled to link mechanism 76 and upper frame 34 and is configured to guide the support assembly motion with respect to the frame, thereby guiding the barrier motion with respect to the upper frame 34. Guide mechanism 78 is configured to allow link mechanism 76 to move along a path having combinations of horizontal and vertical directions so that as panel 74 moves between a lowered position and a raised position and is guided by the link mechanism 76 following the guide mechanism 78, panel 74 moves generally in a vertical direction with respect to intermediate frame 34. As will be explained in further detail below, variations in the configuration of the guide assembly allow the movement path of a barrier between a first position and a second position to be configured for a specific need, such as, for example, a hospital bed with limited space between its frame and a wall to allow a barrier to transition from a lowered position to a raised position.

It is within the scope of the present disclosure for a siderail assembly to include at least one latching mechanism to releasably secure a position of a barrier with respect to a frame of a patient-support apparatus. A latching mechanism may releasably secure a barrier in one or more positions. A latching mechanism may releasably secure a barrier with a support assembly, releasably secure the support assembly with the frame of the patient-support apparatus, and releasably secure the support assembly with the guide assembly.

A caregiver wishing to change the position of panel 74 from a lowered position to a raised position may place a hand on panel 74 and lift panel 74 vertically. As panel 74 is lifted vertically, link mechanism 76 pivots with respect to panel 74, and is guided in vertical and lateral directions with respect to intermediate frame 34 by guide mechanism 78. The translations of link mechanism 76 with respect to intermediate frame 34 due to the configuration of guide mechanism 78 allow panel 74 to translate only in a vertical direction with respect to the caregiver.

Figure 4:
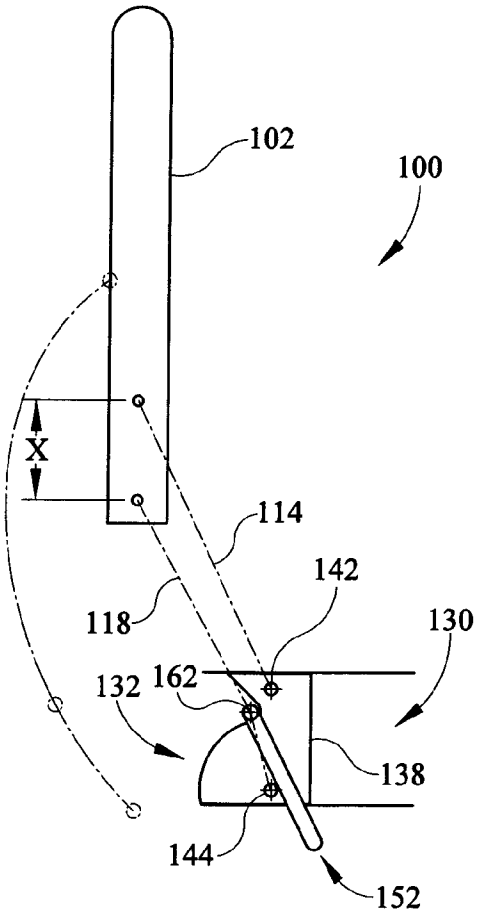
FIGS. 2, 3, 4 are diagrammatic representations of a first illustrative embodiment of a siderail assembly shown in a first, a second, and a third position, respectively.
Figure 3:
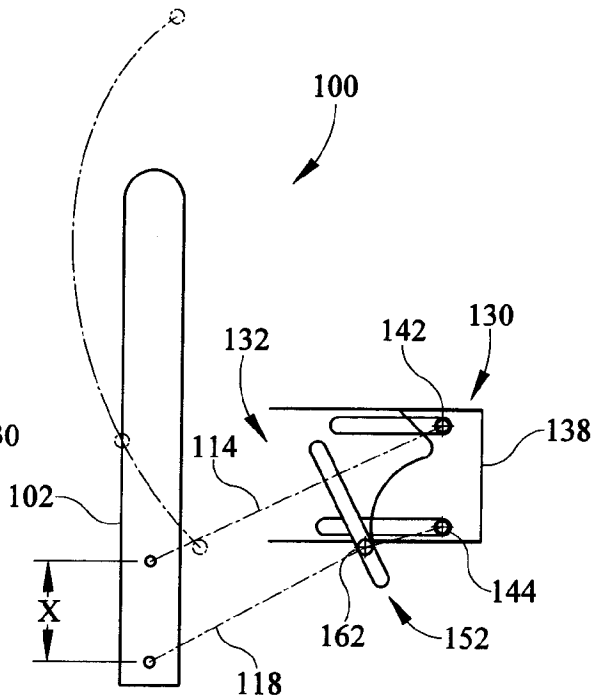
Figure 2:
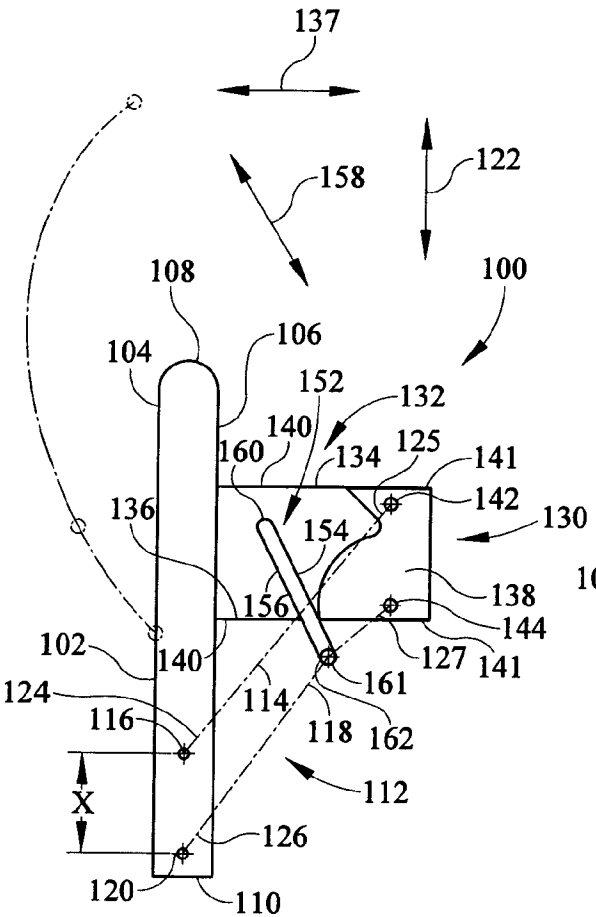

A first illustrative embodiment of a siderail assembly, siderail mechanism 100, is shown diagrammatically in FIGS. 2-4 and includes a barrier embodied as a panel 102, a support assembly embodied as a link mechanism 112, and a guide assembly embodied as guide mechanism 130. Panel 102 includes an outward side 104, an inward side 106, a top portion 108, and a bottom portion 110. Link mechanism 112 includes an upper link 114 having a first end 124 and a second end 125 pivotably coupled to bottom portion 110 of panel 102 about an axis 116. Link mechanism 112 also includes a lower link 118 having a first end 126 pivotably coupled to bottom portion 110 of panel 102 about an axis 120 offset a distance X from axis 116 in a generally vertical direction indicated by arrow 122.

Guide mechanism 130 includes a first guide having a first track 132. First track 132 has a first rail 134 and a second rail 136 extending generally parallel with first rail 134 between a first end 140 and a second end 141 of first track 132 in a generally horizontal direction as indicated by arrow 137. Guide mechanism 130 also includes a first follower, illustratively shown as follower member 138, slidably engaged with first track 132. Follower member 138 is pivotably coupled to second end 125 of upper link 114 so that upper link 114 pivots about an axis 142. Follower member 138 is also coupled to second end 127 of lower link 118 so that lower link 118 pivots about an axis 144 offset from axis 142.

Additionally, guide mechanism 130 includes a second guide illustratively embodied as a second track 152, having a first rail 154 and a second rail 156 extending generally parallel with first rail 154 between a first end 160 and a second end 161 of second track 152 in a direction including horizontal and vertical components, as indicated by arrow 158. Lower link 118 is diagrammatically shown in FIGS. 2-4 as being pivotably coupled to second track 152 about a pivot axis 162 at a point along lower link 118 intermediate to axis 120 and axis 144. Additionally, lower link 118 is illustratively shown slidably engaged with second track 152 so that pivot axis 162 may translate along second track 152 in a direction indicated by arrow 137.

Figure 5:
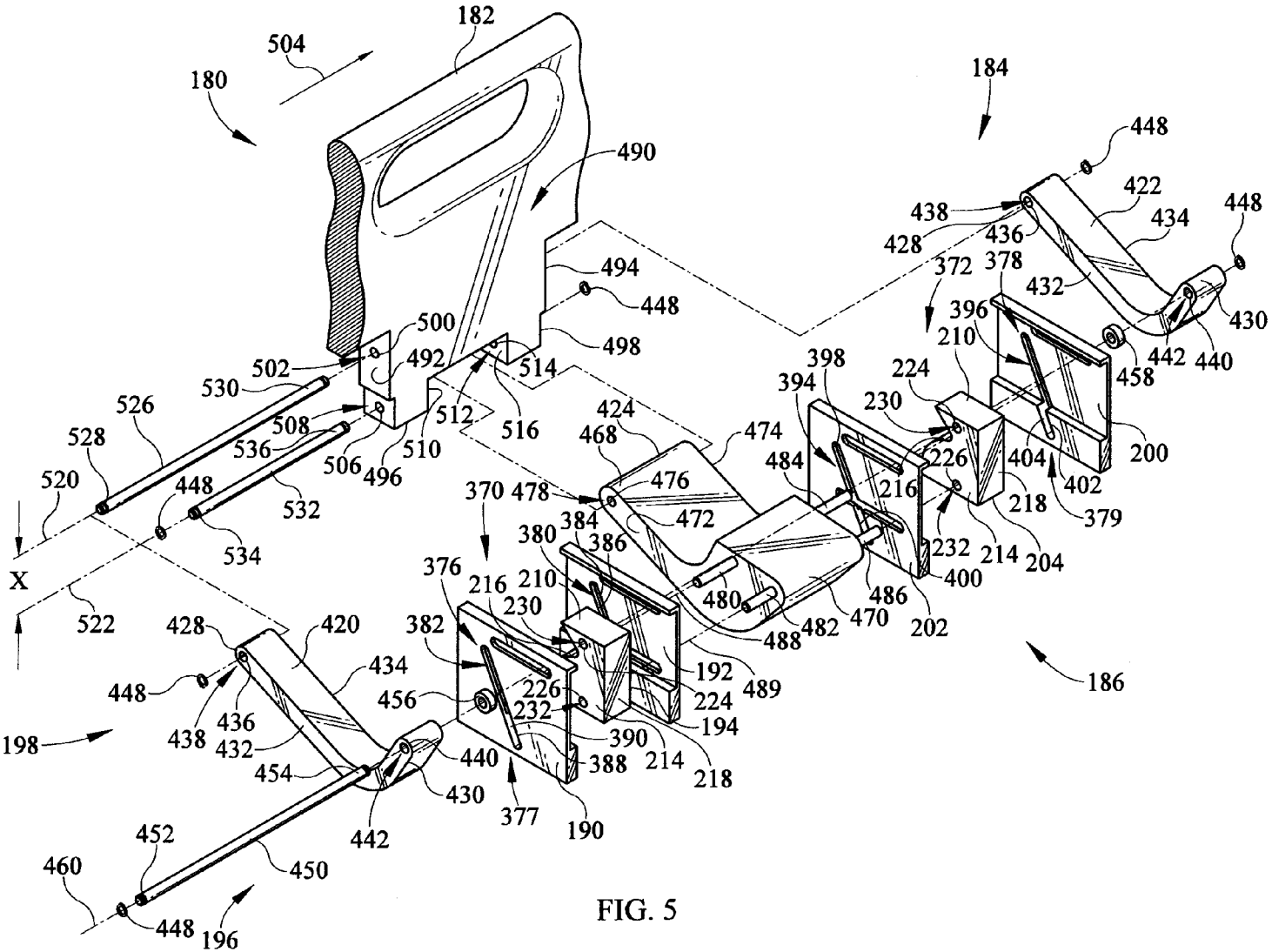
FIG. 5 is an exploded perspective view of the siderail assembly of FIGS. 2-4 with portions cut-away.
Figure 6:
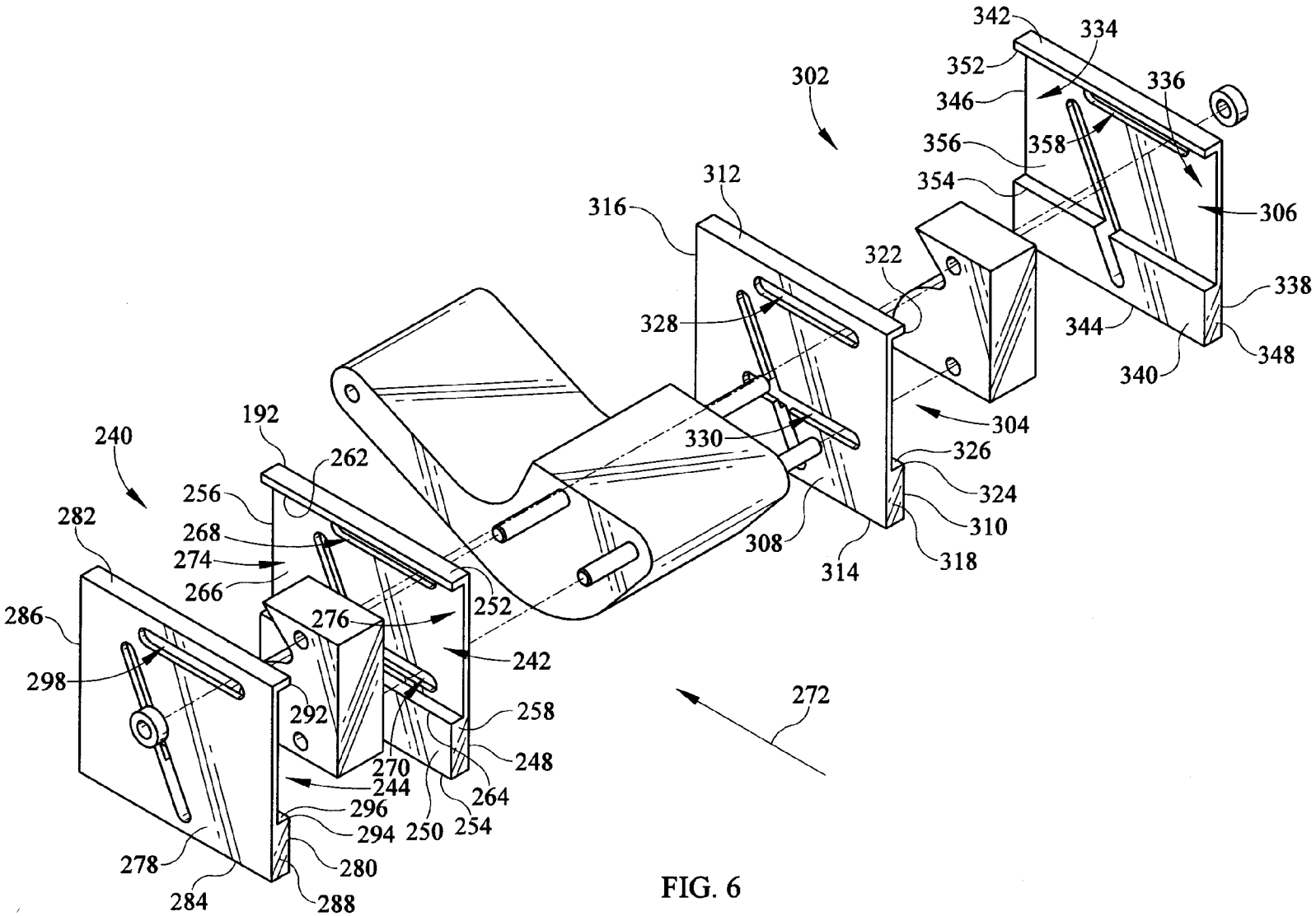
FIG. 6 is an enlarged view of a portion of the exploded siderail assembly of FIG. 5.

As panel 102 moves with respect to guide mechanism 130, second end 125 of upper link 114 and second end 127 of lower link 118 may move rotationally, vertically and horizontally, and pivot axis 162 may move vertically and horizontally with the rotational and translation components of these movements dependent upon the length and shape of the paths defined by the first guide, track 132, and the second guide, track 152. Panel 102 is shown in FIG. 2 in a first position with respect to guide mechanism 130 when follower member 138 is proximate second end 141 of first track 134 and pivot axis 162 is proximate second end 161 of second track 152. Panel 102 is shown in FIG. 3 in a second position with respect to guide mechanism 130 when follower member 138 is proximate second end 141 of first track 134 and pivot axis 162 is intermediate first and second ends 160, 161 of second track 152. Panel 102 is shown in FIG. 5 in a third position with respect to guide mechanism 130 when follower member 138 is proximate the first end 140 of first track 134 and pivot axis 162 is proximate first end 160 of second track 152.

A caregiver wishing to move panel 102 from the position illustratively shown in FIG. 2 to the position illustratively shown in FIG. 4 may begin by placing their hand on top portion 108 of panel 102 and grasping panel 102. They may then exert a force on panel 102 thereby propelling panel 102 along a path having both horizontal and vertical components with respect to the guide mechanism 130 determined by first track 134 and second track 152.

Another embodiment of a siderail assembly illustratively embodied as a siderail mechanism 180, including a barrier illustratively embodied as a panel 182, a support assembly illustratively embodied as a link mechanism 184, and a guide assembly illustratively embodied as a guide mechanism 186, is shown in FIGS. 5-12. Guide mechanism 186 includes first and second tracks 240 and 302 (best seen in FIG. 6) configured to assist in guiding an inward portion 196 of the support assembly, link mechanism 184, in moving along a path, indicated by arrow 272, including a horizontal component. Guide mechanism 186 illustratively includes a first outer plate 190 and a first inner plate 192 to form first track 240, and a first follower member 194 engaged therebetween, as seen best in FIG. 5. Guide mechanism 186 also illustratively includes a second outer plate 200 and a second inner plate 202 to form second track 302, and a second follower member 204 engaged therebetween.

Follower members 194 and 204 have the same structure and features. Follower members 194 and 204 have a top surface 210, a bottom surface (not shown) facing opposite top surface 210, a first plate surface 214, a second plate surface (not shown) facing opposite first plate surface 214, a front surface 216, and a back surface 218 facing opposite front surface 216. First plate surface 214 is formed to include a top aperture 224, and a bottom aperture 226 defining two holes 230 and 232, respectively, that communicate with the second plate surface of follower members 194 and 204.

First track 240 is configured to slidably engage with follower member 194. First track 240 includes a channel 242 formed in first inner plate 192 and a channel 244 formed in first outer plate 190 of guide mechanism 186. Channel 242 is sized so that a portion of top surface 210, a portion of the bottom surface, and the second plate surface of first follower member 194 are engaged therewith. Channel 244 is sized so that a portion of top surface 210, a portion of the bottom surface, and first plate surface 214 of first follower member 194 are engaged therewith.

First inner plate 192 includes a link side 248, a follower side 250 facing opposite link side 248, a top side 252, a bottom side 254 facing opposite top side 252, an outward side 256, and an inward side 258 facing opposite outward side 256. Follower side 250 of first inner plate 192 is formed to include an edge 262 and an edge 264 extending generally parallel with edge 262 between outward side 256 and inward side 258 of first inner plate 192 with a channel surface 266 extending therebetween. Edge 262, edge 264 and channel surface 266 cooperate to define channel 242.

First inner plate 192 includes an upper follower slot 268 extending in a generally horizontal direction, as indicated by arrow 272, formed in follower side 250 and link side 248 of first inner plate 192 and configured to communicate therethrough. First inner plate 192 also includes a lower follower slot 270 extending generally parallel with upper follower slot 268 formed in follower side 250 and link side 248 of first inner plate 192 and configured to communicate therethrough. First follower member 194 is positioned adjacent follower side 250 of first inner plate 192 so that a portion of top surface 210, a portion of the bottom surface, and the second plate surface of first follower member 194 are engaged with channel surface 266. Furthermore, upper follower slot 268 is configured to communicate with hole 230 of first follower member 194 as first follower member 194 slides along first track 240 in the direction indicated by arrow 272. Lower follower slot 270 is configured to communicate with hole 232 of first follower member 194 as first follower member 194 slides along first track 240 in the direction indicated by arrow 272.

First outer plate 190 includes a link side 278, a follower side 280 facing opposite link side 278, a top side 282, a bottom side 284 facing opposite top side 282, an outward side 286, and an inward side 288 facing opposite outward side 286. Follower side 280 of first outer plate 190 is formed to include an edge 292 and an edge 294 extending generally parallel with edge 292 between outward side 286 and inward side 288 of first inner plate 190 with a channel surface 296 extending therebetween. Edge 292, edge 294 and channel surface 296 cooperative to define channel 244.

First outer plate 190 includes an upper follower slot 298 extending in a generally horizontal direction, as indicated by arrow 272, formed in follower side 280 and link side 278 of first inner plate 190 and configured to communicate therethrough. First follower member 194 is positioned adjacent follower side 280 of first outer plate 190 so that a portion of top surface 210, a portion of the bottom surface, and first plate surface 214 of first follower member 194 are engaged with channel surface 296. Furthermore, upper follower slot 298 is configured to communicate with hole 230 of first follower member 194 as first follower member 194 slides along first track 240 in the direction indicated by arrow 272.

First track 240 includes a first end 274 defined by a portion of channel 242 adjacent outward side 256 of first inner plate 192 and a portion of channel 244 adjacent outward side 286 of first outer plate 190. First track 240 also includes a second end 276 defined by a portion of channel 242 adjacent inward side 258 of first inner plate 192 and a portion of channel 244 adjacent inward side 288 of first outer plate 190.

Second track 302 is configured to slidably engage with follower member 204. Second track 302 includes a channel 304 formed in second inner plate 202 and a channel 306 formed in second outer plate 200 of guide mechanism 186. Channel 304 is sized so that a portion of top surface 210, a portion of the bottom surface, and first plate surface 214 of second follower member 204 are engaged therewith. Channel 306 is sized so that a portion of top surface 210, a portion of the bottom surface, and the second plate surface of second follower member 204 are engaged therewith.

Second inner plate 202 includes a link side 308, a follower side 310 facing opposite link side 308, a top side 312, a bottom side 314 facing opposite top side 312, an outward side 316, and an inward side 318 facing opposite outward side 316. Follower side 310 of second inner plate 202 is formed to include an edge 322 and an edge 324 extending generally parallel with edge 322 between outward side 316 and inward side 318 of first inner plate 202 with a channel surface 326 extending therebetween. Edge 322, edge 324 and channel surface 326 cooperate to define channel 242.

Second inner plate 202 includes an upper follower slot 328 extending in a generally horizontal direction, as indicated by arrow 272. Upper follower slot 328 is formed in follower side 310 and link side 308 of second inner plate 202 and configured to communicate therethrough. Second inner plate 202 also includes a lower follower slot 330 extending generally parallel with upper follower slot 328. Lower follower slot 330 is formed in follower side 310 and link side 308 of second inner plate 202 and configured to communicate therethrough. Second follower member 204 is positioned adjacent follower side 310 of second inner plate 202 so that a portion of top surface 210, a portion of the bottom surface, and first plate surface 214 of second follower member 204 are engaged with channel surface 326. Furthermore, upper follower slot 328 is configured to communicate with hole 230 of second follower member 204 as second follower member 204 slides along second track 302 in the direction indicated by arrow 272. Lower follower slot 330 is configured to communicate with hole 232 of second follower member 204 as second follower member 204 slides along second track 302 in the direction indicated by arrow 272.

Second outer plate 200 includes a link side 338, a follower side 340 facing opposite link side 338, a top side 342, a bottom side 344 facing opposite top side 342, an outward side 346, and an inward side 348 facing opposite outward side 346. Follower side 340 of second outer plate 200 is formed to include an edge 352 and an edge 354 extending generally parallel with edge 352 between outward side 346 and inward side 348 of second outer plate 200 with a channel surface 356 extending therebetween. Edge 352, edge 354 and channel surface 356 cooperate to define channel 306.

Second outer plate 200 includes an upper follower slot 358 extending in a generally horizontal direction, as indicated by arrow 272, formed in follower side 340 and link side 338 of second outer plate 200 and configured to communicate therethrough. Second follower member 204 is positioned adjacent follower side 340 of second outer plate 200 so that a portion of top surface 210, a portion of the bottom surface, and the second plate surface of second follower member 204 are engaged with channel surface 356. Furthermore, upper follower slot 358 is configured to communicate with hole 230 of second follower member 204 as second follower member 204 slides along second track 302 in the direction indicated by arrow 272.

Second track 302 includes a first end 334 defined by a portion of channel 304 adjacent outward side 316 of second inner plate 202 and a portion of channel 306 adjacent outward side 346 of second outer plate 200. Second track 302 also includes a second end 336 defined by a portion of channel 304 adjacent inward side 318 of second inner plate 202 and a portion of channel 306 adjacent inward side 348 of second outer plate 200.

Guide mechanism 186 also includes a third track 370 formed within first inner and outer guide plates 190 and 192, respectively, and a fourth track 372 formed within second inner and outer guide plates 200 and 202, respectively. Tracks 370 and 372 are configured to assist inward portion 196 of link mechanism 184 in moving along a path, indicated by arrow 374, including a vertical component. Inward portion 196 of link mechanism 184 may move along a path between a first end 376 of third track 370 and a second end 377 of third track 370 and a path between a first end 378 of fourth track 372 and a second end 379 of fourth track 372.

Third track 370 includes a first guide channel 380 formed in first inner plate 192 and a second guide channel 382 formed in first outer plate 190. First inner plate 192 includes an aperture 384 formed in follower side 250 and an aperture (not shown) formed in link side 248 of first inner plate 192, and a channel surface 386 extending therebetween. Aperture 384, and the aperture formed in link side 248, and channel surface 386 cooperatively define first guide channel 380. Likewise, first outer plate 190 includes an aperture (not shown) formed in follower side 280 and an aperture 388 formed in link side 278 of first outer plate 190, and a channel surface 390 extending therebetween. Aperture 388, and the aperture formed in follower side 280, and channel surface 390 cooperatively define second guide channel 382.

Fourth track 372 includes a first guide channel 394 formed in second inner plate 202 and a second guide channel 396 formed in second outer plate 200. Second inner plate 202 includes an aperture (not shown) formed in follower side 310 and an aperture 398 formed in link side 308 of second inner plate 202, and a channel surface 400 extending therebetween. Aperture 398, and the aperture formed in follower side 310, and channel surface 400 cooperatively define first guide channel 394. Likewise, second outer plate 200 includes an aperture 402 formed in follower side 340 and an aperture (not shown) formed in link side 338 of second outer plate 200, and a channel surface 404 extending therebetween. Aperture 388, the aperture formed in follower side 280, and channel surface 404 cooperatively define second guide channel 396.

A support assembly illustratively embodied as a link mechanism 184 illustratively includes a first upper link 420, a second upper link 422, and a lower link 424, each extending between panel 182 and guide mechanism 186. While first upper link 420 is adjacent to first outer plate 192, and second upper link 422 is adjacent to second outer plate 200, first upper link 420 and second upper link 422 have the same structure and features.

First upper link 420 and second upper link 422 include a first end 428, a second end 430, a first side 432, and a second side 434 facing opposite first side 432. First ends 428 of links 420 and 422 are located within outward portion 198 of link mechanism 184 and second ends 430 of links 420 and 422 are located within inward portion 196 of link mechanism 184. First ends 428 of links 420 and 422 include an aperture 436 formed within the first side defining an opening to a first pivot hole 438 communicating with second side 430. Likewise, second ends 430 of links 420 and 422 include an aperture 440 formed within the first side defining an opening to a second pivot hole 442 communicating with the second side 430, as shown best in FIG. 5. Second ends 430 of links 420 and 422 are positioned adjacent link side 278 of first outer plate 190 and link side 338 of second outer plate 200, respectively. More specifically, second end 430 of first upper link 420 is positioned so that second pivot hole 442 of first upper link 420 communicates through upper follower slot 298 of first outer plate 190 and with hole 230 of first follower member 194. Likewise, second end 430 of second upper link 422 is positioned so that opening 442 of second upper link 422 communicates through upper follower slot 358 of second outer plate 200 and with hole 230 of second follower member 204.

Link mechanism 184 includes a first pivot rod 450 having a first end 452 and a second end 454. Pivot rod 450 is positioned to extend through first pivot hole 438 of first upper link 420, upper follower slot 268 of first outer plate 190, hole 230 of first follower member 194 and upper follower slot 298 of first inner plate 192. Pivot rod 450 further extends through upper follower slot 328 of second inner plate 202, hole 230 of second follower member 204, and upper follower slot 358 of second outer plate 200. Fasteners 448 are illustratively shown coupled to first end 452 and second end 454 of pivot rod 450. The center of pivot rod 450 defines an axis 460 about which first and second upper links 420 and 422 pivot with respect to guide mechanism 186. Pivot rod 450 may be configured to rotatably engage with first and second upper links 420 and 422. Pivot rod 450 may also be configured to rotatably engage with first outer plate 190, first follower member 194, first inner plate 192, second inner plate 202, second follower member 204, and second outer plate 200.

A bearing 456 is illustratively shown in FIG. 5 circumferentially engaging pivot rod 450 between first upper link 420 and first outer plate 190 and a bearing 458 is illustratively shown circumferentially engaging pivot rod 450 between second upper link 422 and second outer plate 200. Bearings 456, 458 may assist in movement of upper links 420 and 422 with respect to outer plates 190 and 200, respectively. It is within the scope of the present disclosure that bearings could be included in a siderail assembly where surfaces may be engaged and/or coupled.

Lower link 424 of link mechanism 184 includes a first end 468, a second end 470, a first side 472, and a second side 474 facing opposite first side 472. First end 468 of lower link 424 is located within outward portion 198 of link mechanism 184 and second end 470 of lower link 424 is located within inward portion 196 of link mechanism 184. First end 468 of lower link 424 includes an aperture 476 formed within first side 472 defining an opening to a first pivot hole 478 communicating with second side 474.

Lower link 424 includes four pivot rods 480, 482, 484, and 486 coupled to lower link 424 within inward portion 196 of link mechanism 184. Pivot rod 480 and pivot rod 482 are coupled to first side 472 of lower link 424. Pivot rod 480 is illustratively shown in FIG. 5 positioned at second end 470 of lower link 424 extending away from first side 472. Pivot rod 482 is illustratively shown positioned intermediate first end 468 and second end 470 of lower link 424 extending away from first side 472. Pivot rod 484 and pivot rod 486 are coupled to second side 474 of lower link 424. Pivot rods 484 and 486 are positioned opposite pivot rods 480 and 482, respectively, extending away from second side 474.

The first side 472 of lower link 424 is positioned adjacent link side 248 of first inner plate 192 and second side 474 of lower link 424 is positioned adjacent link side 308 of second inner plate 202. More specifically, first pivot rod 480 of lower link 424 extends through channel 380 of first inner plate 192 and channel 382 of first outer plate 190. First pivot rod 480 is configured to pivot within channel 380 of first inner plate 192 and channel 382 of first outer plate 190 about axis 488 as first pivot rod 480 follows the path defined by their shape. Second pivot rod 482 of lower link 424 extends through lower follower slot 270 of first inner plate 192 and is configured to pivot within hole 232 of first follower member 194 about axis 489. Likewise, third pivot rod 484 of lower link 424 extends through channel 394 of second inner plate 202 and channel 396 of second outer plate 200. Third pivot rod 484 is configured to pivot within channel 394 of second inner plate 202 and channel 396 of second outer plate 200 about axis 488 as third pivot rod 484 follows the path defined by their shape. Fourth pivot rod 486 of lower link 424 extends through lower follower slot 330 of second inner plate 202 and is configured to pivot within hole 232 of second follower member 204 about axis 489.

As first pivot rod 480 of lower link 424 follows a path defined by track 370, first follower member 194 follows first track 240. Likewise, as third pivot rod 484 of lower link 424 follows a path defined by track 372, second follower member 204 follows second track 302. Front surfaces 216 of follower members 194 and 204 are formed so that follower members 194 and 204 do not obstruct movement of first pivot rod 480 and third pivot rod 484, respectively, as they follow tracks 370 and 372, respectively.

A barrier illustratively embodied as panel 182, is configured to couple with a support assembly illustratively embodied as link mechanism 184 that is coupled to guide assembly illustratively embodied as guide mechanism 186. As the support assembly movement is guided by the guide assembly, the barrier movement is guided by the support assembly. Panel 182 pivots about an axis 520 with respect to upper links 420, 422 and about a second axis 522 with respect to lower link 424. Axis 520 is offset from axis 522, as shown in FIG. 5 by a dimension X.

Panel 182 includes a mounting portion 490 having a first side 492, a second side 494 facing opposite first side 492, and a first lower member 496 and a second lower member 498 offset from first lower member 496. First side 492 of mounting portion 490 is formed to include an aperture 500 defining an opening to a first hole 502 communicating with second side 494 of mounting portion 490 in a generally horizontal direction indicated by arrow 504. First side 492 of mounting portion 490 is also formed to include an aperture 506 located on first lower member 496. Aperture 506 defines an opening to a second hole 508 communicating with a side 510 of first lower member 496 in a generally longitudinal direction indicted by arrow 504. Mounting portion 490 includes a third hole 512, collinear with second hole 508, formed in second lower member 498. An aperture 514 is formed in a side 516 of second lower member 498 and defines an opening to hole 512 communicating with second side 494 of mounting portion 490.

Second side 434 of first end 428 of first upper link 420 is positioned adjacent first side 492 of mounting portion 490 such that hole 438 of upper link 420 communicates with hole 502 of mounting portion 490. First side 432 of first end 428 of second upper link 422 is positioned adjacent second side 494 of mounting portion 490 such that hole 438 of second upper link 422 communicates with hole 502. Link mechanism 184 includes a rod 526 having a first end 528 and a second end 530. Rod 526 is positioned within hole 438 of first upper link 420, first hole 502 of mounting portion 490, and hole 438 of second upper link 422 such that first end 528 extends away from first side 432 of first upper link 420 and second end 530 extends away from second side 434 of second upper link 422. Hole 438 of first upper link 420, first hole 502 of mounting portion 490, hole 438 of second upper link 422 and rod 526 are configured to allow panel 182 to pivot with respect to first upper link 420 and second upper link 422 about axis 520. Axis 520 is collinear with the longitudinal centerline of rod 526.

First end 468 of lower link 424 is positioned adjacent mounting portion 490 of panel 182. More specifically, first side 472 of lower link 424 is positioned adjacent side 510 of first lower member 496 such that hole 478 of lower link 424 communicates with second hole 508 of mounting portion 490. Additionally, second side 474 of lower link 424 is positioned adjacent side 516 of second lower member 498 such that hole 478 of lower link 424 communicates with third hole 512 of mounting portion 490. Link mechanism 184 includes a rod 532 having a first end 534 and a second end 536. Rod 532 is positioned within second hole 508 of mounting portion 490, hole 478 of lower link 424, and third hole 512 of mounting portion 490 such that first end 534 of rod 532 extends away from first side 492 of mounting portion 490 and second end 536 of rod 532 extends away from second side 494 of mounting portion 490. Second hole 508 of mounting portion 490, hole 478 of lower link 424, third hole 512 of mounting portion 490, and rod 526 are configured to allow panel 182 to pivot with respect to lower link 424 about axis 522. Axis 522 is collinear with the longitudinal centerline of rod 532.

Figure 7:
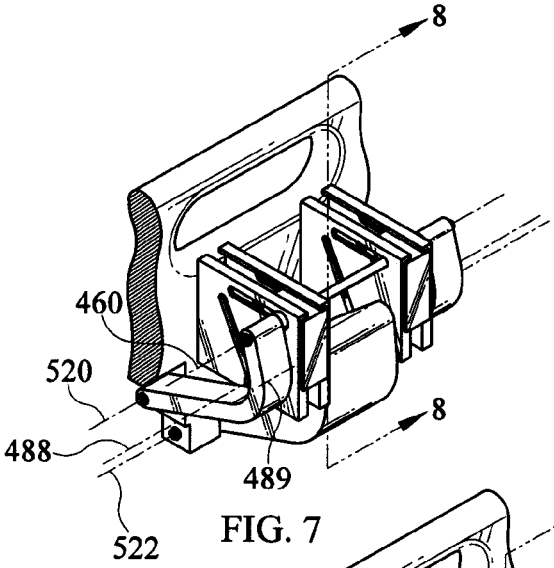
FIG. 7 is a perspective view of the embodiment shown in FIG. 6, FIG. 7 showing the assembly in an assembled state and a lowered position.
Figure 8:
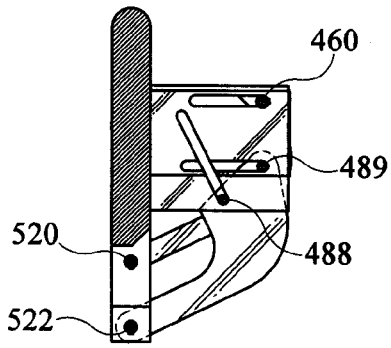
FIG. 8 is a view of the assembly of FIG. 7 taken along the lines 8-8 of FIG. 7.
Figure 9:
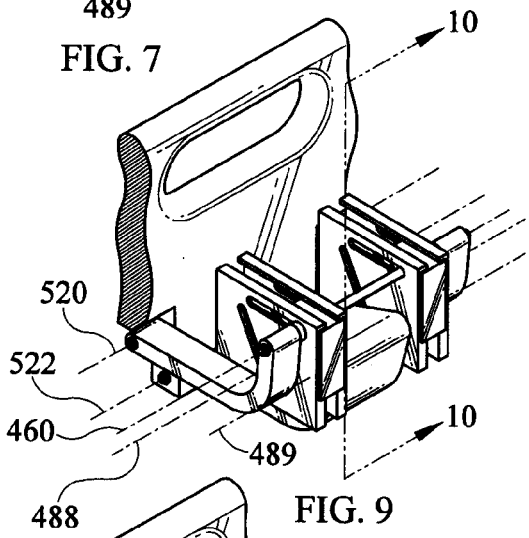
FIG. 9 is a perspective view similar to the view of FIG. 7, the assembly shown in a position partially raised position.
Figure 10:
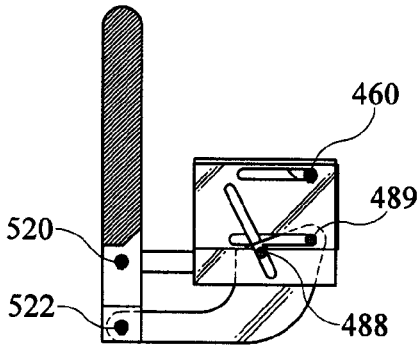
FIG. 10 is a view of the assembly of FIG. 9 taken along the lines 10-10 of FIG. 9.
Figure 11:
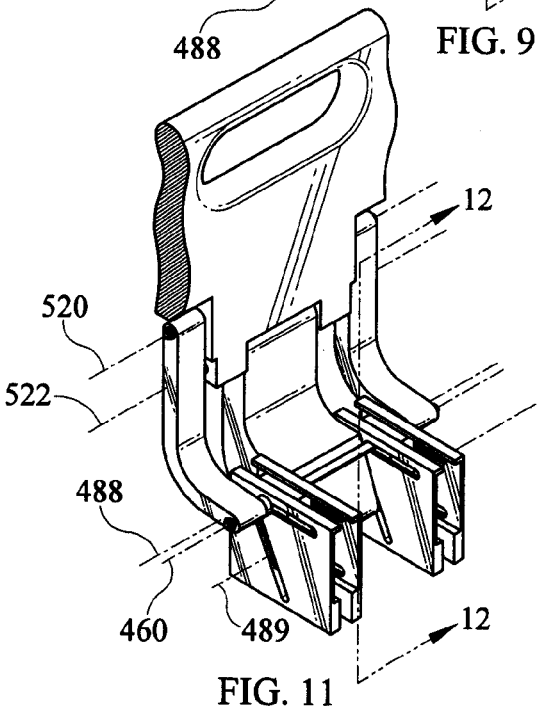
FIG. 11 is a perspective view similar to the view of FIG. 7, the assembly shown in a position fully raised position.

Panel 182 is shown in FIGS. 7, 8 in a first position with respect to guide mechanism 186 when first and second follower members 194 and 204 are proximate second end 276 of first track 240 and second end 336 of second track 302, respectively. Pivot axis 488 is also shown proximate second end 377 of third track 370 and proximate second end 379 of fourth track 372. Panel 182 is shown in FIGS. 9, 10 in a second position with respect to guide mechanism 186 when first and second follower members 194 and 204 are proximate second end 276 of first track 240 and second end 336 of second track 302, respectively. Pivot axis 488 is also shown intermediate first and second ends 376, and 377 of third track 370 and intermediate first and second ends 378, and 379 of fourth track 372. Panel 182 is shown in FIGS. 10, 11 in a third position with respect to guide mechanism 186 when first and second follower members 194 and 204 are proximate first end 274 of first track 240 and first end 334 of second track 302, respectively. Pivot axis 488 is also shown proximate first end 376 of third track 370, and first end 378 of fourth track 372.

Figure 12:
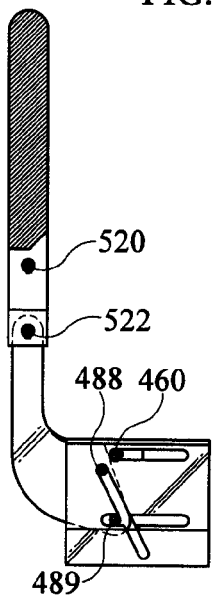
FIG. 12 is a view of the assembly of FIG. 11 taken along the lines 12-12 of FIG. 11.
Figure 13:
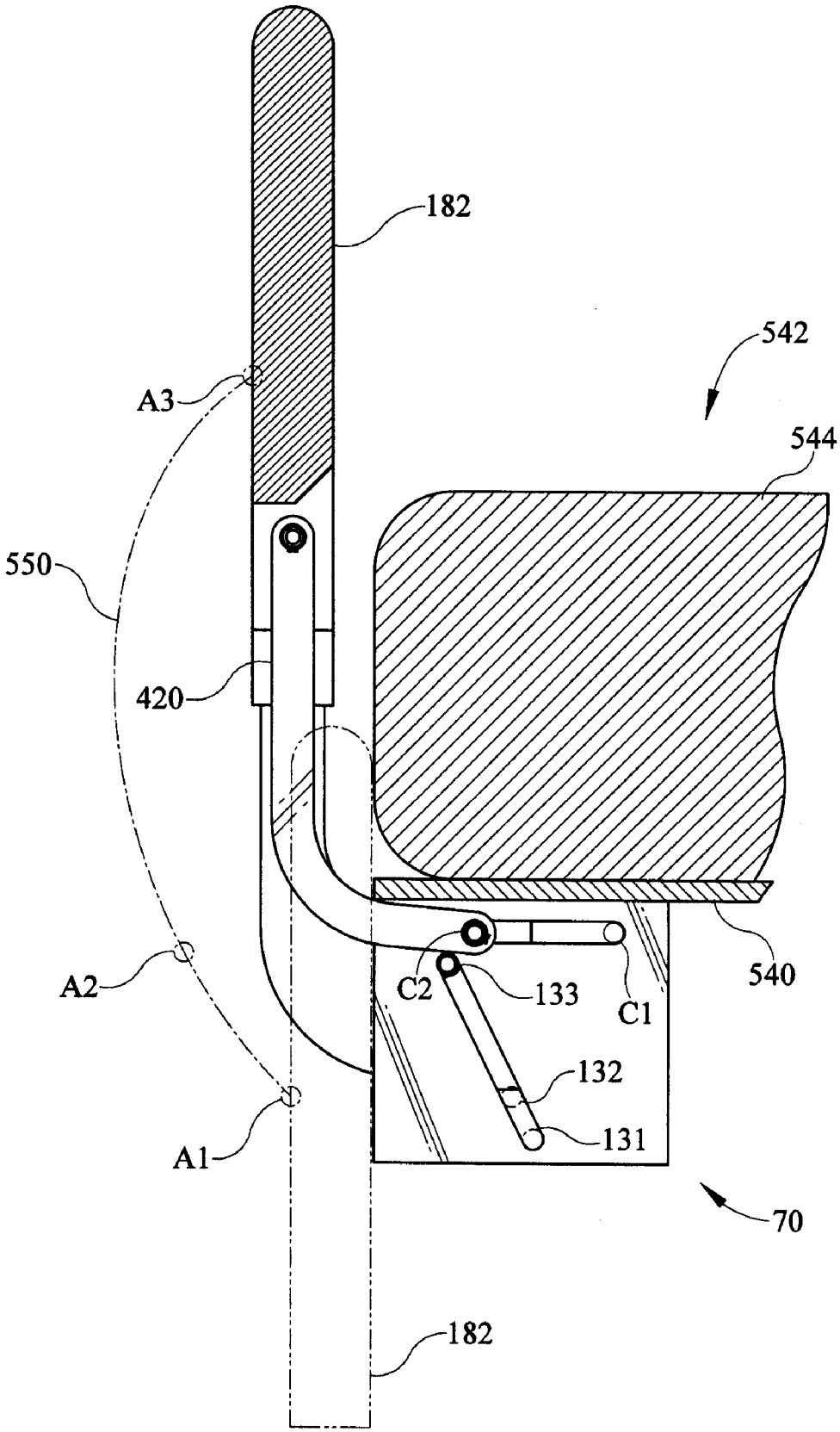
FIG. 13 is a side elevation view of the siderail assembly of FIG. 12 positioned under a portion of an upper frame of a patient-support apparatus with a patient-support surface supported by the upper frame, with a path of movement of a portion of the siderail illustrated diagrammatically with a line extending between the barrier in the third position and an outline of the barrier in the first position.

Guide mechanism 186 of siderail mechanism 180 is illustratively shown in FIG. 12 coupled to a frame 540 of a patient-support apparatus 542 including a patient-support surface 544. While guide mechanism 186 is shown coupled to a bottom region of frame 540, it is within the scope of the present disclosure that a guide assembly may be coupled to a side region, a bottom region, and a top region of a frame of a patient-support apparatus.

Panel 182 of siderail mechanism 180 in the third position with respect to guide mechanism 186, an outline view of panel 182 in the first position with respect to guide mechanism 186, and a line 550 illustratively showing the path of a point on panel 182 as panel 182 moves between the first position and the third position are shown in FIG. 12. A caregiver wishing to change the position of panel 182 from a lowered position to a raised position may place a hand on panel 182 and move panel 182. As panel 182 is moved, first and second upper links 420 and 422 and lower link 424 move with respect to frame 540, and are guided in vertical and lateral directions with respect to frame 540 by guide mechanism 186. The translations of links 420, 422, and 424 with respect to frame 540 due to the configuration of guide mechanism 186 allow the point on panel 182 to translate along a path identified by line 550.

If panel 182 begins in a lowered position where the point on panel 182 is at a position A1 along the path indicated by line 550, axis 460 about which second end 430 of first upper link 420 pivots with respect to guide mechanism 186 is in a position C1, and axis 488 about which first and third pivot rods 480 and 484 pivot with respect to guide mechanism 186 is in a position B1. When panel 182 transitions to a position where the point on panel 182 is at a position A2 along the path indicated by line 550, axis 460 remains in position C1, and axis 488 is in a position B2. When panel 182 transitions to a position where the point on panel 182 is at a position A3 along the path indicated by line 550, axis 460 is in a position C2, and axis 488 is in a position B3. Configuration of first, second, third and fourth tracks 240, 302, 370 and 372 cooperatively determines the path panel 182 follows with respect to guide mechanism 186.

While upper links 420 and 422 are pivotably coupled to follower members 194 and 204, and follower members 194 and 204 are slidably engaged with tracks 240 and 302, respectively, it is within the scope of the present disclosure for an upper link to be pivotably coupled to a track of a guide assembly about an axis and configured to allow the axis to translate along the track. Furthermore, while lower link 424 is pivotably coupled to tracks 376 and 396 about axis 488, and configured to allow axis 488 to translate along tracks 370 and 372, it is within the scope of the present disclosure for a lower link to be pivotably coupled to a follower slidably engaged with a track. Also, it is within the scope of the present disclosure for a support assembly to include only one upper link, such, for example, first upper link 420.

The present embodiment illustratively shows lower link 424 pivotably coupled to guide mechanism 186 about axis 488 and axis 522 where axis 488 is intermediate of axis 522 and axis 489 at first end 468 of lower link 424. Additionally, axis 488 is illustratively shown to translate in direction including a vertical component, and axis 522 is illustratively shown to translate in a direction including a horizontal component. It is within the scope of the present disclosure that guide mechanism 186 and lower link 424 could be configured so that lower link 424 is pivotably coupled to guide mechanism 186 about a first pivot axis translatable in a direction including a vertical component and about a second pivot axis translatable in a direction including a horizontal component where the second pivot axis is intermediate axis 522 and the first pivot axis.

While the present disclosure illustratively shows lower link 424 pivotably coupled to guide mechanism 186 about axis 488 and 522, it is within the scope of the present disclosure for an upper link to be pivotably coupled to the guide assembly about two axis configured to translate with respect to the guide assembly and the lower link to be pivotably coupled to the guide assembly about one axis configured to translate. Additionally, it is within the scope of the present disclosure that the guide assembly and an upper link could be configured so that the upper link is pivotably coupled to the guide assembly about a first pivot axis translatable in a direction including a vertical component and about a second pivot axis translatable in a direction including a horizontal component where the second pivot axis is intermediate the outward portion of the support assembly and the first pivot axis.

Another embodiment of a siderail assembly, siderail mechanism 600, is shown diagrammatically in FIGS. 14A-14E including a barrier, a support assembly, and a guide assembly. A barrier, panel 602, is illustratively shown having an outward side 604, an inward side 606, a top portion 608, and a bottom portion 610. A support assembly illustratively embodied as link mechanism 612 is illustratively shown to include an upper link 614 having a first end 624 and a second end 626. First end 624 is pivotably coupled to bottom portion 610 of panel 602 about an axis 616. Link mechanism 612 is illustratively shown to include a lower link 618 having a first end 628 and a second end 630. First end 628 of lower link 618 is pivotably coupled to bottom portion 610 of panel 602 about an axis 620 offset a distance Y from axis 616.

A guide assembly illustratively embodied as a guide mechanism 634 includes a first guide, illustratively shown as a first track 636, having a first end 638, a second end 640, and an intermediate portion 642. A guide assembly may also include a second guide, illustratively shown as a second track 646 having a first end 648, a second end 650, and an intermediate portion 652. Additionally, a guide assembly includes a third guide illustratively embodied as a third track 656 having a first end 658, a second end 660, an upper portion 662, and a lower portion 664. Second end 626 of upper link 614 is diagrammatically shown in FIGS. 14A-14E as being pivotably coupled to first track 636 about a pivot axis 668. Additionally, second end 630 of lower link 618 is illustratively shown pivotably coupled to second track 646 about a pivot axis 670. Lower link 618 is also shown pivotably coupled to third track 656 at a point intermediate first end 628 and second end 630 of lower link 618 about a pivot axis 672. Guide mechanism 634 is configured so that pivot axis 668 translates along first track 636, pivot axis 670 translates along second track 646, and pivot axis 672 translates along third track 656.

Figures 14A, 14B, 14C, 14D, 14E:
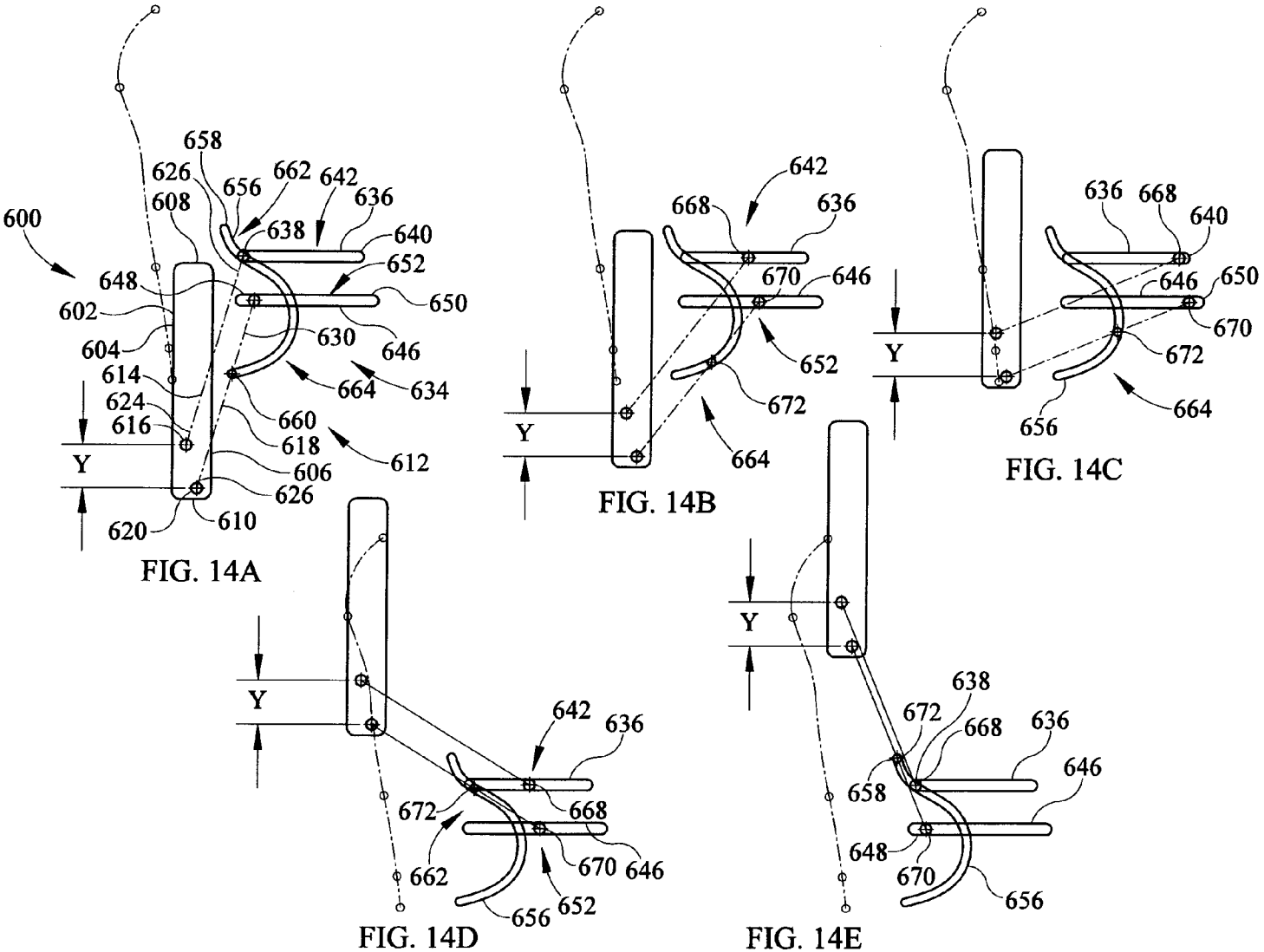
FIGS. 14A, 14B, 14C, 14D and 14E are diagrammatic views of a second illustrative embodiment of a siderail assembly, shown in a first, second, third, fourth, and fifth position, respectively.
Figure 15:
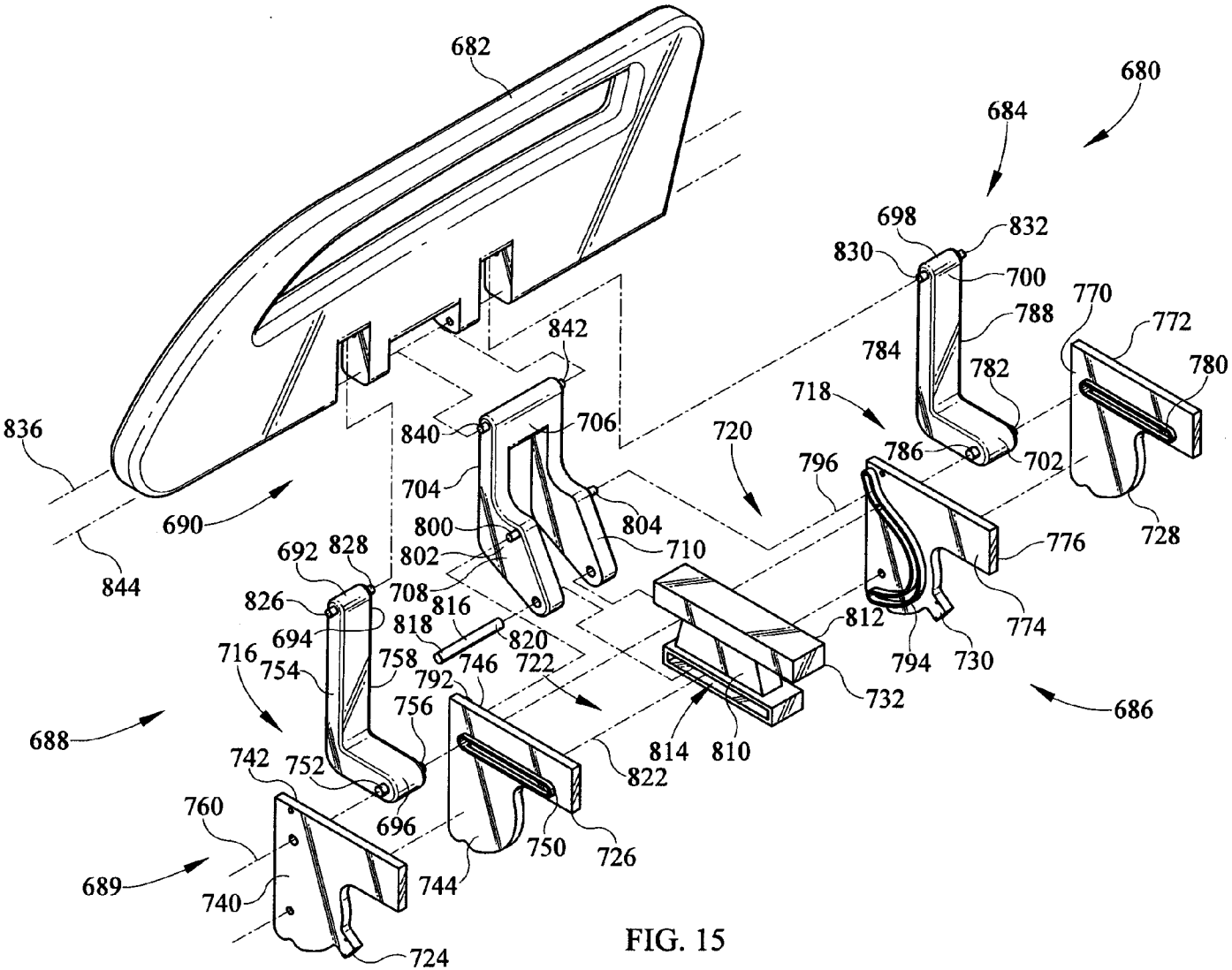
FIG. 15 is an exploded perspective view of the siderail assembly of FIGS. 14A-14E.

As panel 602 moves with respect to guide mechanism 634, second end 626 of upper link 614 and second end 630 of lower link 618 may move rotationally, vertically and horizontally, and pivot axis 672 may move vertically and horizontally with the rotational and translational components of these movements dependent upon the length and shape of the paths defined by first track 636, second track 646, and third track 656. Panel 602 is shown in FIG. 14A in a first position with respect to guide mechanism 130. The first position includes the pivot axis 668 proximate first end 638 of first track 636, pivot axis 670 proximate first end 648 of second track 646, and pivot axis 672 proximate second end 660 of third track 656. Panel 602 is shown in FIG. 14B in a second position with respect to guide mechanism 634 with pivot axis 668 within intermediate portion 642 of first track 636, pivot axis 670 within intermediate portion 652 of second track 646, and pivot axis 672 within lower portion 664 of third track 656.

Furthermore, panel 602 is shown in FIG. 14C in a third position with respect to guide mechanism 130. The third position includes pivot axis 668 proximate second end 640 of first track 636, pivot axis 670 proximate second end 650 of second track 646, and pivot axis 672 with the lower portion 664 of third track 656. Panel 602 is shown in FIG. 14E in a fourth position with respect to guide mechanism 634 with pivot axis 668 within intermediate portion 642 of first track 636, pivot axis 670 within intermediate portion 652 of second track 646, and pivot axis 672 within upper portion 662 of third track 656. Panel 602 is shown in FIG. 14F in a fifth position with respect to guide mechanism 634 with the pivot axis 668 proximate first end 638 of first track 636, pivot axis 670 proximate first end 648 of second track 646, and pivot axis 672 proximate first end 658 of third track 656.

A caregiver wishing to move panel 602 from the position illustratively shown in FIG. 14A to the position illustratively shown in FIG. 14E may begin by placing their hand on top portion 608 of panel 602 and grasping panel 602. They may then exert a force on panel 602 thereby propelling panel 602 along a path that includes both horizontal and vertical components with respect to the guide mechanism 634 determined by first track 636, second track 646, and third track 656.

Another embodiment of a siderail assembly including a barrier, a support assembly, and a guide assembly is shown in FIGS. 15-20. The siderail assembly is illustratively shown as siderail mechanism 680 including a panel 682, a link mechanism 684, and a guide mechanism 686. Panel 682 includes a mounting portion 690 coupled to link mechanism 684, as will be described in further detail below.

Link mechanism 684 includes an outward portion 688 coupled to panel 682 and an inward portion 689 coupled to guide mechanism 686. Link mechanism 684 also includes a first upper link 692 having a first end 694 and a second end 696, a second upper link 698 having a first end 700 and a second end 702, and a lower link 704 having an outer portion 706, a first inner member 708, and a second inner member 710. First end 694 of first upper link 692, first end 700 of second upper link 698, and outer portion 706 of lower link 704 are included within outward portion 686 of link mechanism 684. Second end 696 of first upper link 692, second end 702 of second upper link 698, and first and second inner members 708 and 710 of lower link 704 are included within inward portion 689 of link mechanism 684.

Guide mechanism 686 includes four guides configured to guide the movements of second end 696 of first upper link 692, second end 702 of second upper link 698, and first and second lower members 708 and 710 of lower link 704 thereby guiding the position of panel 682 with respect to guide mechanism 686. A first track 716 is configured to guide second end 696 of first upper link 692, a second track 718 is configured to guide second end 702 of second upper link 698, a third track 720 is configured to guide first and second lower members 708 and 710 of lower link 704 along a path including horizontal and vertical components, and a fourth track 722 is configured to guide first and second lower members 708 and 710 of lower link 704 along a path including a horizontal component, as will be described in further detail below.

Guide mechanism 686 further includes a first outer plate 724, a first inner plate 726, a second outer plate 728, a second inner plate 730, and a center member 732. First outer plate 724 includes a first side 740, and a second side 742 and first inner plate 726 includes a first side 744, and a second side 746. First outer plate 724 and first inner plate 726 each also include a channel 750 coupled to side 742 and side 744, respectively. Channels 750 of first outer plate 724 and first inner plate 726 extend generally parallel to each other in a generally horizontal direction. Channel 750 of first outer plate 724 is engaged with a knob 752 coupled to a first side 754 of first upper link 692. Channel 750 of first inner plate 726 is engaged with a knob 756 coaxially extending opposite knob 752 and coupled to a second side 758 of first upper link 692. Channel 750 of first outer plate 724 is configured to allow knob 752 to pivot about an axis 760 collinear with the longitudinal centerline of knobs 752 and 756 and pivot therein. Likewise, channel 750 of first inner plate 726 is configured to allow knob 756 to pivot about axis 760 and translate therein. Channel 750 of first outer plate 724 and channel 750 of first inner plate 726 cooperatively define track 716 of guide mechanism 686.

Second outer plate 728 includes a first side 770, and a second side 772 and second inner plate 730 includes a first side 774, and a second side 776. Second outer plate 728 and second inner plate 730 each also include a channel 780 coupled to side 770 and side 776, respectively. Channels 780 of second outer plate 728 and second inner plate 730 extend generally parallel to each other in a generally horizontal direction. Channel 780 of second outer plate 728 engages a knob 782 coupled to a second side 788 of second upper link 698. Channel 780 of second inner plate 730 engages a knob 786 coaxially extending opposite knob 782 and coupled to a first side 784 of second upper link 698. Channel 780 of first inner plate 730 is configured to allow knob 786 to pivot about axis 760 that is also collinear with the longitudinal centerline of knobs 782 and 786 and translate therein. Likewise, channel 780 of second inner plate 730 is configured to allow knob 782 to pivot about axis 760 and translate therein. Channel 780 of second outer plate 728 and channel 780 of second inner plate 730 cooperatively define track 718 of guide mechanism 686.

First inner plate 726 includes a curved channel 792 coupled to second side 746 and second inner plate 730 includes a curved channel 794 coupled to first side 774. Curved channels 792 and 794 of first inner plate 726 and second inner plate 730, respectively, extend generally parallel to each other. Channel 792 of first inner plate 726 engages a knob 800 coupled to first inner member 708 of lower link 704 extending away from a first side 802 of lower link 704. Channel 794 of second inner plate 730 engages a knob 804 coupled to second inner member 710 of lower link 704 and coaxially extending opposite knob 800. Curved channel 792 of first inner plate 726 is configured to allow knob 800 to pivot about an axis 796 collinear with the longitudinal centerline of knobs 800 and 804 and translate therein. Likewise, curved channel 794 of second inner plate 730 is configured to allow knob 804 to pivot about axis 796 and translate therein. Channel 792 of second outer plate 728 and channel 794 of second inner plate 730 cooperatively define third track 720 of guide mechanism 686.

Center member 732 of guide mechanism 686 includes a first side 810 and a second side 812 facing opposite first side 810. Center member 732 further includes a slot 814 formed in first side 810 communicating with second side 812. Lower link 704 includes a pivot rod 816 having a first end 818 coupled to first inner member 708 and a second end 820 coupled to second inner member 710 and extending therebetween. Lower link 704 is configured so that pivot rod 816 extends through slot 814 of center member 732. Furthermore, slot 814 of center member 732 and pivot rod 816 are configured so that lower link 704 pivots about an axis 822 collinear with the longitudinal centerline of pivot rod 816 and first and second inner members 708 and 710 of lower link 704 translate along a path defined by slot 814 of center member 732. Fourth track 722 of guide mechanism 686 is defined by slot 814 of center member 732.

As mentioned above, mounting portion 690 of panel 682 is coupled to link mechanism 684 of siderail mechanism 680. First upper link 692 of link mechanism 684 includes a knob 826 coupled to first end 694 of first upper link 692 and extending away from first side 754 of first upper link 692. First upper link 692 also includes a knob 828 coupled to first end 694 coaxially aligned with knob 826 and extending away opposite knob 826. Likewise, second upper link 698 includes a knob 830 coupled to first end 700 of second upper link 698 and extending away from first side 784 of first upper link 698. Second upper link 698 also includes a knob 832 coupled to first end 700 coaxially aligned with knob 830 and extending away opposite knob 830.

Lower link 704 includes a knob 840 coupled to outer portion 706 of lower link 704 extending away from first side 802 of lower link 704. Lower link 704 also includes a knob 842 coupled to outer portion 706 of lower link 704 coaxially aligned with knob 840 and extending away opposite knob 840.

Mounting portion 690 of panel 682 includes a first receiver (not shown) configured to engage knobs 826 and 828 of first upper link 692 such that panel 682 pivots with respect to first upper link 692 about an axis 836 collinear with the longitudinal centerline of knobs 826 and 828 of first upper link 692. Mounting portion 690 of panel 682 also includes a second receiver (not shown) configured to engage knobs 830 and 832 of second upper link 698 such that panel 682 pivots with respect to second upper link 698 about axis 836, which is also collinear with the longitudinal centerline of knobs 830 and 832 of second upper link 698. Mounting portion 690 of panel 682 also includes a third receiver (not shown) configured to engage knobs 840 and 842 of lower link 704 such that panel 682 pivots with respect to lower link 704 about an axis 844 collinear with the longitudinal centerline of knobs 840 and 842.

Figure 16:
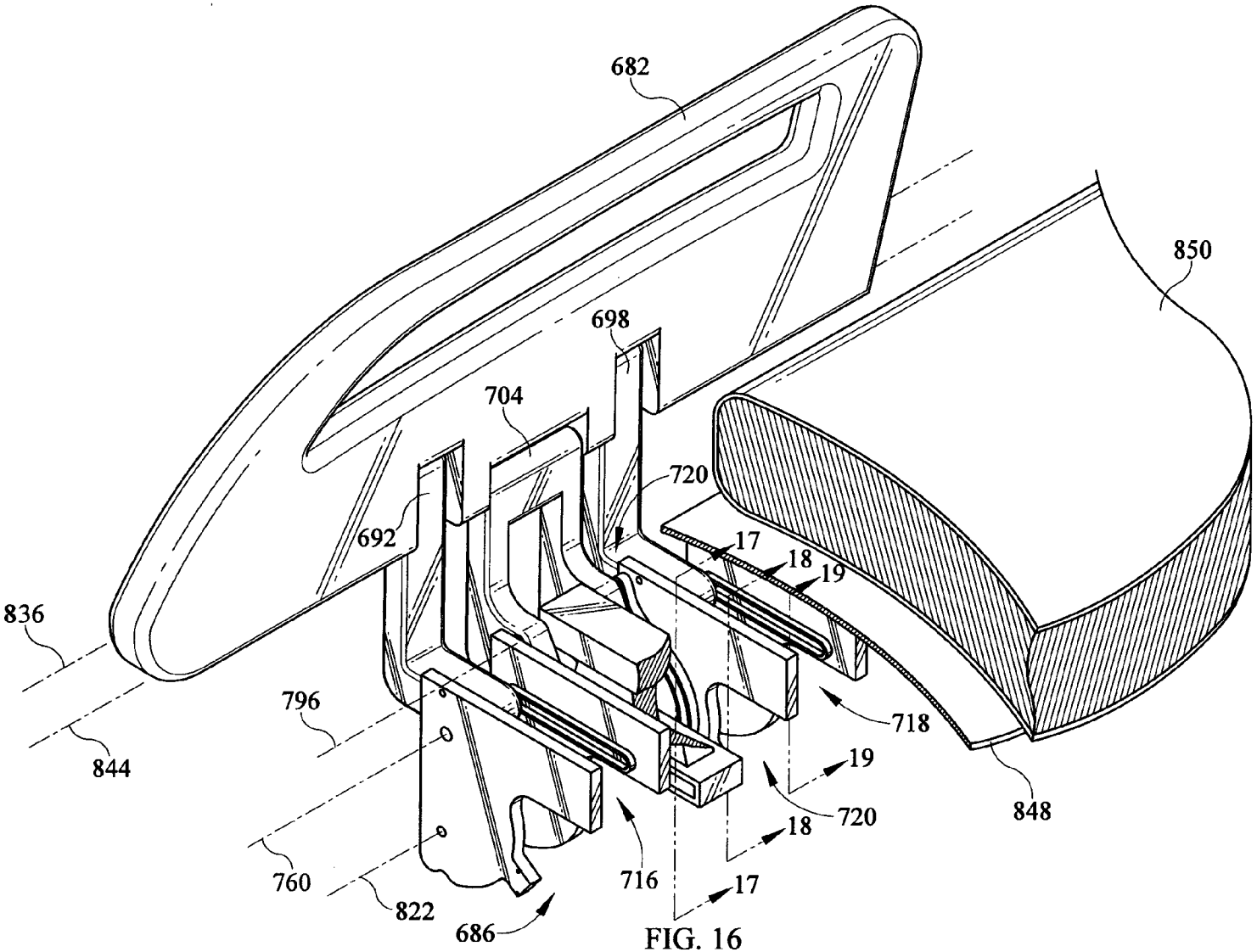
FIG. 16 is a perspective view of the siderail assembly in FIG. 15 in a third position, the siderail assembly positioned under a portion of a patient-support apparatus and a patient-support surface.
Figure 18C:
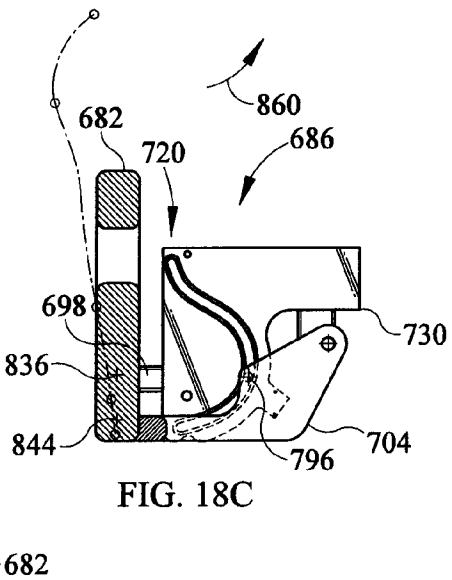
FIGS. 18A, 18B, 18C, 18D and 18E are sectional views of the siderail assembly of FIG. 16, taken along line 18-18, showing the siderail assembly shown in the first, second, third, fourth and fifth positions, respectively.
Figure 18B:
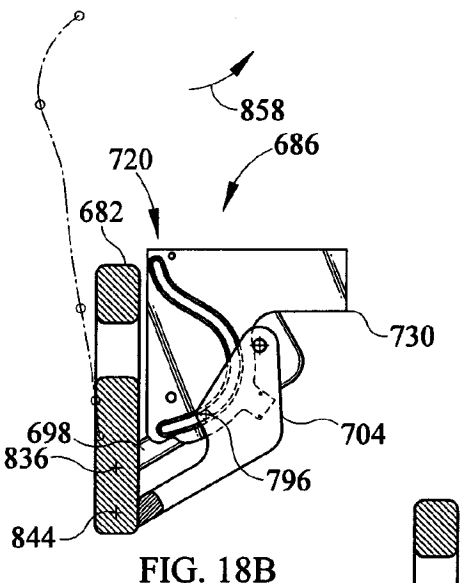
Figure 18A:
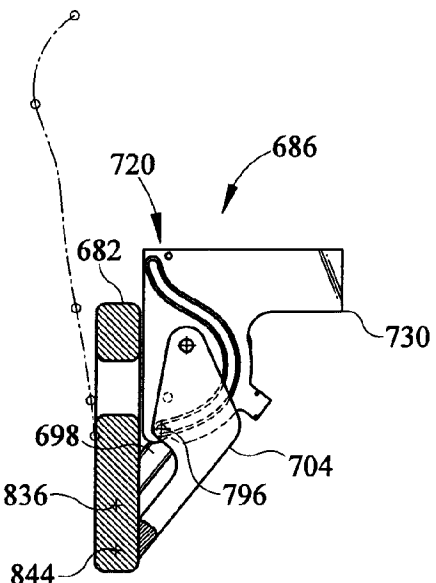
Figure 18E:
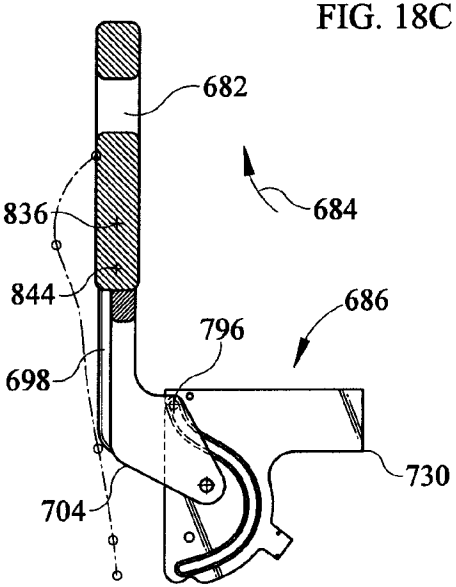
Figure 18D:
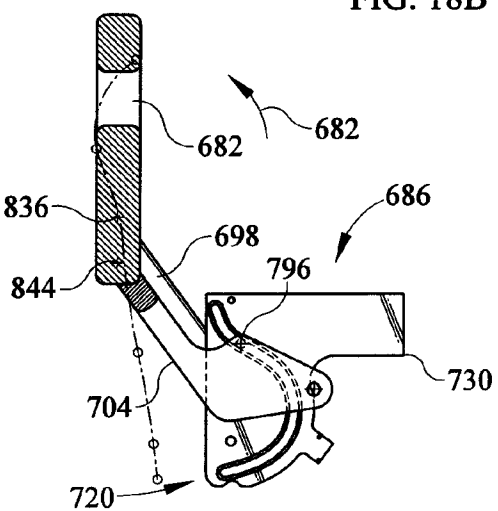
Figures 19A, 19B, 19C, 19D, 19E:
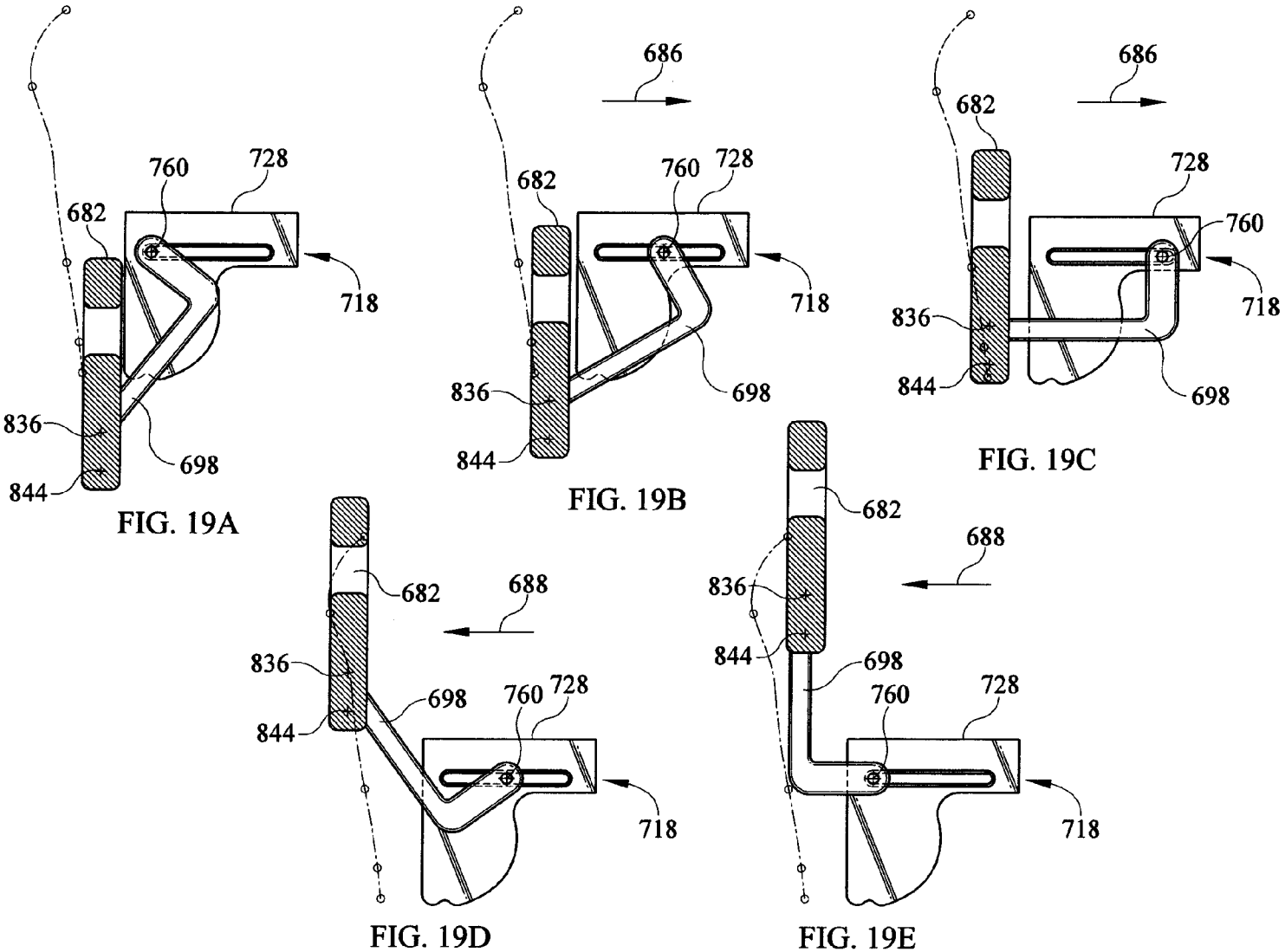
FIGS. 19A, 19B, 19C, 19D, and 19E are sectional views of the siderail assembly of FIG. 16, taken along line 19-19, showing the siderail assembly shown in the first, second, third, fourth and fifth positions, respectively.

Siderail mechanism 680 is illustratively shown in FIG. 16 coupled to a frame 848 of a patient support apparatus supporting a mattress 850. While not shown, it is within the scope of the present disclosure for a siderail assembly illustratively embodied as, for example, siderail mechanism 680, to include at least one latching mechanism for securing the position of the barrier with respect to the frame of a patient-support apparatus. For example, panel 602 is illustratively shown in a raised position adjacent frame 848. A latching mechanism may be configured to releasably engage panel 602 with first upper link 692, second upper link 698, and lower link 704. A latching mechanism may also be configured to releasably engage first upper link 692, second upper link 698, and lower link 704 with frame 848 of the patient-support apparatus. A latching mechanism may be configured to releasably engage first upper link 692, second upper link 698, and lower link 704 with the guide mechanism 634. A siderail assembly illustratively embodied as siderail mechanism 680, may use one or more latching mechanisms.

A caregiver wishing to move panel 602 with respect to frame 848 of the patient support apparatus may place their hand upon panel 602, release a latch mechanism if present, and move panel 602 into a new position. If panel 602 is moved to a different position, upper links 692 and 698 may pivot with respect to panel 602 about axis 836, lower link 704 may pivot with respect to panel 602 about axis 844, upper links 692 and 698 may pivot with respect to guide mechanism 686 about axis 760, axis 760 may translate with respect to guide mechanism 686 along first and second tracks 716 and 718, lower link 704 may pivot with respect to guide mechanism 686 about axis 796, axis 796 may translate with respect to guide mechanism 686 along third track 720, lower link 704 may pivot with respect to guide mechanism 686 about axis 822, and axis 822 may translate with respect to guide mechanism 686 along fourth track 722.

Siderail mechanism 680 is illustratively shown in a first position, a second position, a third position, a fourth position, and a fifth position in FIGS. 17A, 17B, 17C, 17D, and 17E, respectively, in a sectional view taken along line 17-17 in FIG. 16. When transitioning from the first position to the second position, lower link 704 pivots clockwise with respect to axis 822 and axis 822 translates in a direction indicated by an arrow 854. When transitioning from the second position to the third position, lower link 704 pivots further clockwise with respect to axis 822 and axis 822 translates further in a direction indicated by arrow 854. When transitioning from the third position to the fourth position, lower link 704 pivots further clockwise with respect to axis 822 and axis 822 translates in a direction indicated by an arrow 856. When transitioning from the fourth position to the fifth position, lower link 704 pivots further clockwise with respect to axis 822 and axis 822 translates in a direction indicated by arrow 856.

Siderail mechanism 680 is illustratively shown in the first position, the second position, the third position, the fourth position, and the fifth position in FIGS. 18A, 18B, 18C, 18D, and 18E, respectively, in a sectional view taken along line 18-18 in FIG. 16. When transitioning from the first position to the second position, lower link 704 pivots clockwise with respect to axis 796 and axis 796 translates in a direction indicated by an arrow 858. When transitioning from the second position to the third position, lower link 704 pivots further clockwise with respect to axis 796 and axis 796 translates further in a direction indicated by arrow 860. When transitioning from the third position to the fourth position, lower link 704 pivots further clockwise with respect to axis 796 and axis 796 translates in a direction indicated by an arrow 862. When transitioning from the fourth position to the fifth position, lower link 704 pivots further clockwise with respect to axis 796 and axis 796 translates in a direction indicated by arrow 864.

Siderail mechanism 680 is illustratively shown in the first position, the second position, the third position, the fourth position, and the fifth position in FIGS. 19A, 19B, 19C, 19D, and 19E, respectively, in a sectional view taken along line 19-19 in FIG. 16. When transitioning from the first position to the second position, upper link 698 pivots clockwise with respect to axis 760 and axis 760 translates in a direction indicated by an arrow 866. When transitioning from the second position to the third position, upper link 698 pivots further clockwise with respect to axis 760 and axis 760 translates further in a direction indicated by arrow 866. When transitioning from the third position to the fourth position, upper link 698 pivots further clockwise with respect to axis 760 and axis 760 translates in a direction indicated by an arrow 868. When transitioning from the fourth position to the fifth position, upper link 698 pivots further clockwise with respect to axis 760 and axis 760 translates in a direction indicated by arrow 868.

Figure 20:
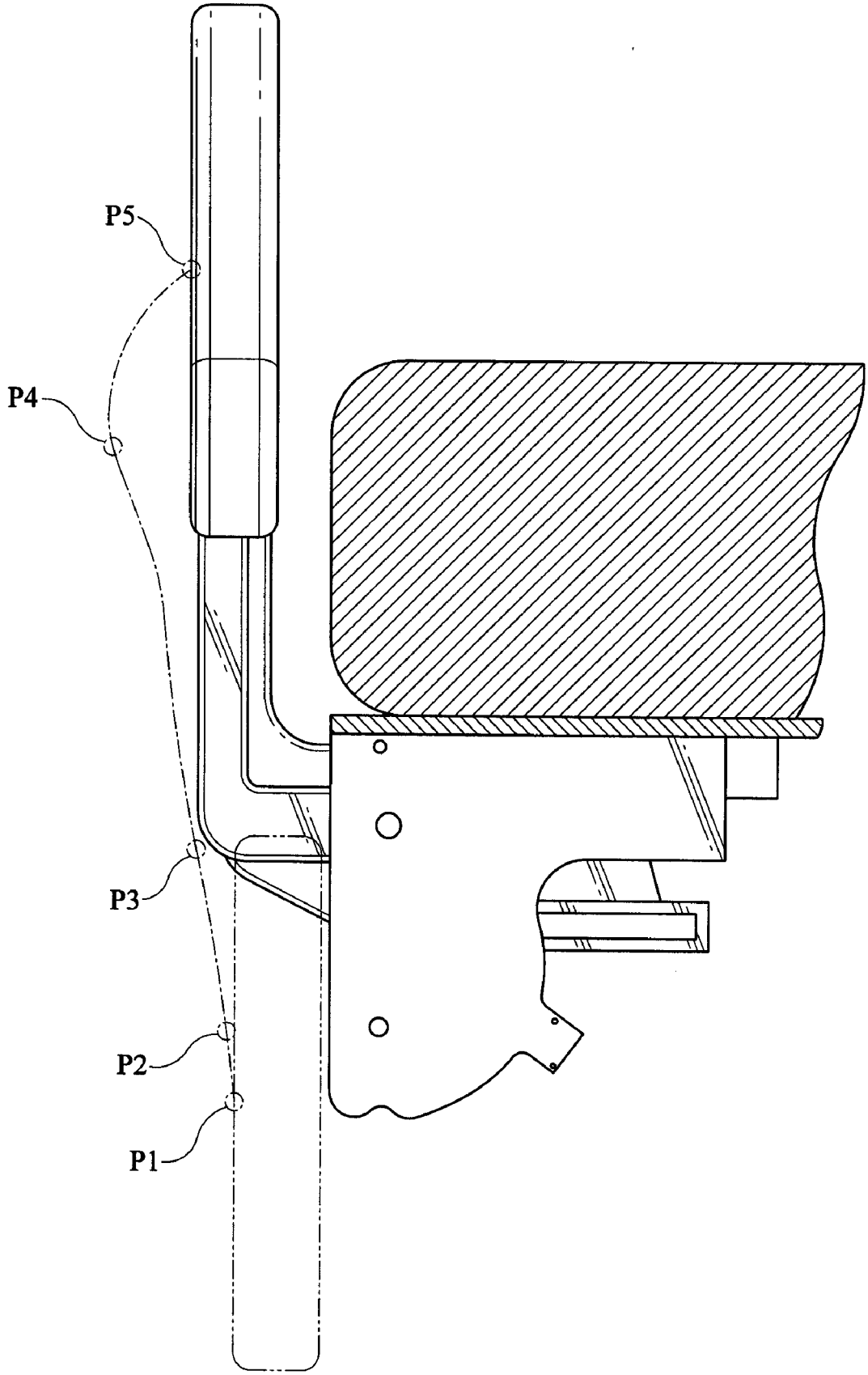
FIG. 20 is a side elevation view of the siderail assembly of FIG. 16 positioned under a portion a patient-support apparatus and a patient-support surface, the barrier positionable relative to the frame along a path illustrated with a line.

Guide mechanism 686 of siderail mechanism 680 is illustratively shown in FIG. 20 coupled to a frame 872 of a patient-support apparatus including a patient-support surface 874. While guide mechanism 686 is shown coupled to a bottom region of frame 872, it is within the scope of the present disclosure that a guide assembly may be coupled to a side region, a bottom region, and a top region of a frame of a patient-support apparatus.

Panel 682 of siderail mechanism 680 in the fifth position with respect to guide mechanism 686, an outline view of panel 682 in the first position with respect to guide mechanism 686, and a line 876 illustratively showing the path of a point on panel 682 as siderail mechanism 680 moves between the first position, the second position, the third position, the fourth position, and the fifth position, as indicated in FIGS. 17A-17E, 18A-18E, 19A-19E. The location of the point on panel 682 along line 876 when siderail mechanism 680 is in the first position is indicated by P1, the location of the point when siderail mechanism 680 is in the second position is indicated by P2, the location of the point when the siderail mechanism 680 is in the third position is indicated by P3, the location of the point when siderail mechanism 680 is in the fourth position is indicated by P4, and the location of the point when siderail mechanism 680 is in the fifth position is indicated by P5. A caregiver wishing to change the position of panel 682 from a lowered position to a raised position may place a hand on panel 682 and move panel 682 upward between P1 and P5. As panel 682 is moved, first and second upper links 692 and 698 and lower link 704 may move with respect to frame 872, and may be guided in vertical and horizontal directions with respect to frame 872 by guide mechanism 686. The translations of links 692, 698 and 704 with respect to frame 872 due to the configuration of guide mechanism 686 allow the point on panel 682 to translate along a path identified by line 876.

It is within the scope of the present disclosure for a guide assembly to be configured to allow a support assembly to move with respect to the guide assembly dependent upon expected use, and thus allow a barrier to move with respect to the guide assembly dependent upon expected use. For example, a guide assembly may be configured to allow a barrier to have separate movements of horizontal translation and vertical translation to avoid interference of the barrier with a frame or patient-support surface. Furthermore, a first guide assembly may be in a first configuration and a second guide assembly may be in a second configuration, where the first configuration allows the guide assembly to allow the barrier to move to a first lowered position and move to a first raised position, and the second configuration allows the guide assembly to allow the barrier to move to a second lowered position lower than the first lowered position and move to a second raised position higher than the first raised position.

While it is in the scope of the present disclosure for varying configurations of a guide assembly to allow varying vertical positions of a barrier, it is also within the scope of the present disclosure for varying configurations of a guide assembly to allow varying horizontal positions of a barrier. Furthermore, varying configurations of a guide assembly may allow varying paths to two or more positions of a barrier.

It is within the scope of the present disclosure for a guide assembly to be configured to guide the movement of a support assembly between a first position, a second position and a third position, where the second and third position allow the barrier to be at a higher position than what the first position allows and at least a portion of the path between the first position and second position is not the same as at least a portion of the path between the first position and third position. A siderail assembly configured to allow a barrier to travel different paths to the same or similar vertical positions relative to a guide assembly may allow a siderail assembly to be configured for multiple uses. Additionally, paths available for a barrier to travel with respect to a guide assembly may be selectively made available to a user of the siderail assembly dependent upon the typical expected use.

For example, a guide assembly may be configured to allow a barrier to follow a path with respect to the guide assembly having a first portion translate generally horizontally to avoid an obstruction such as a bottom side or a perimeter side of a patient-support surface supported by a patient-support apparatus or a frame of a patient-support apparatus, and a second portion translate generally vertically for raising above and below the top surface of the patient-support surface or the frame. A guide assembly may be configured to allow a barrier to follow a path with respect to the guide assembly having a portion translate generally vertically to allow a minimum gap between two frames of two patient-support apparatuses positioned adjacent to each other for purposes, for example, of transferring a patient between the two patient-support apparatuses independent of the position of the barrier with respect to the guide assembly. It is within the scope of the present disclosure for the guide assembly, support assembly, and barrier of a siderail assembly to be configured to allow positioning of the barrier with respect to the guide assembly for a variety of uses.

The present embodiment illustratively shows lower link 704 pivotably coupled to guide mechanism 686 about axis 796 and axis 822 where axis 796 is intermediate of axis 844 and axis 822. Additionally, axis 796 is illustratively shown to translate in direction including a vertical component, and axis 822 is illustratively shown to translate in a direction including a horizontal component. It is within the scope of the present disclosure for guide mechanism 686 and lower link 704 to be configured so that lower link 704 is pivotably coupled to guide mechanism 686 about a first pivot axis translatable in a direction including a vertical component and about a second pivot axis translatable in a direction including a horizontal component where the second pivot axis is intermediate axis 844 and the first pivot axis.

While the present disclosure illustratively shows lower link 704 pivotably coupled to guide mechanism 686 about two axis 796 and 822, it is within the scope of the present disclosure for an upper link to be pivotably coupled to the guide assembly about two axis configured to translate with respect to the guide assembly and the lower link to be pivotably coupled to the guide assembly about one axis configured to translate with respect to the guide assembly. Additionally, it is within the scope of the present disclosure that the guide assembly and an upper link could be configured so that the upper link is pivotably coupled to the guide assembly about a first pivot axis translatable in a direction including a vertical component and about a second pivot axis translatable in a direction including a horizontal component where the second pivot axis is intermediate the outward portion of the support assembly and the first pivot axis.

While this embodiment illustratively shows two upper links 692 and 698, it is within the scope of the present disclosure for a support assembly of a siderail assembly to include one or more upper links. Additionally, while this embodiment illustratively shows one lower link 704, it is within the scope of the present disclosure for a support assembly of a siderail assembly to include one or more lower links.

While the illustrative embodiments of FIGS. 1-20 through a complete path of travel, it may be desirable to limit the travel of a siderail. For example, if a patient support apparatus is capable of achieving positions in which the siderail would interfere with portions of the patient support apparatus or with the floor, it may be appropriate to limit either the travel of the patient support apparatus or the siderail to prevent interference.

Figure 21:
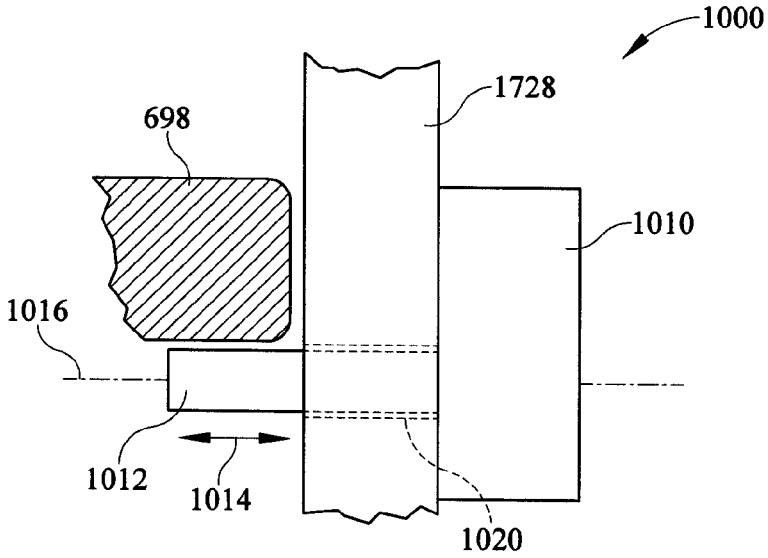
FIG. 21 is a cross-sectional view of a link mechanism for a siderail assembly including a solenoid which is actuable to limit the travel of the link mechanism.
Figure 22:
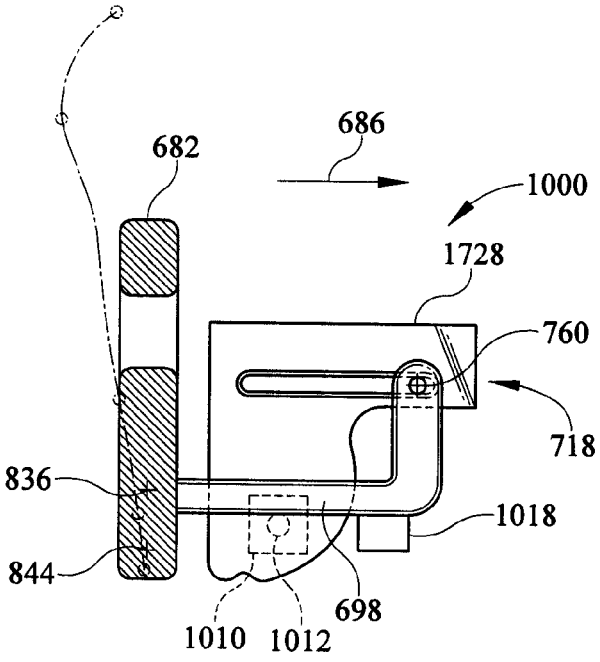
FIGS. 22 and 23 are side views of the link mechanism of FIG. 21 with the solenoid shown in phantom.
Figure 23:
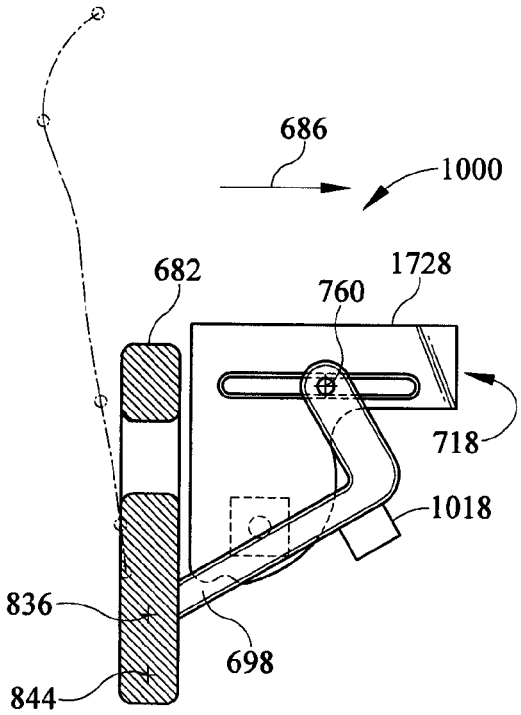
Figure 24:
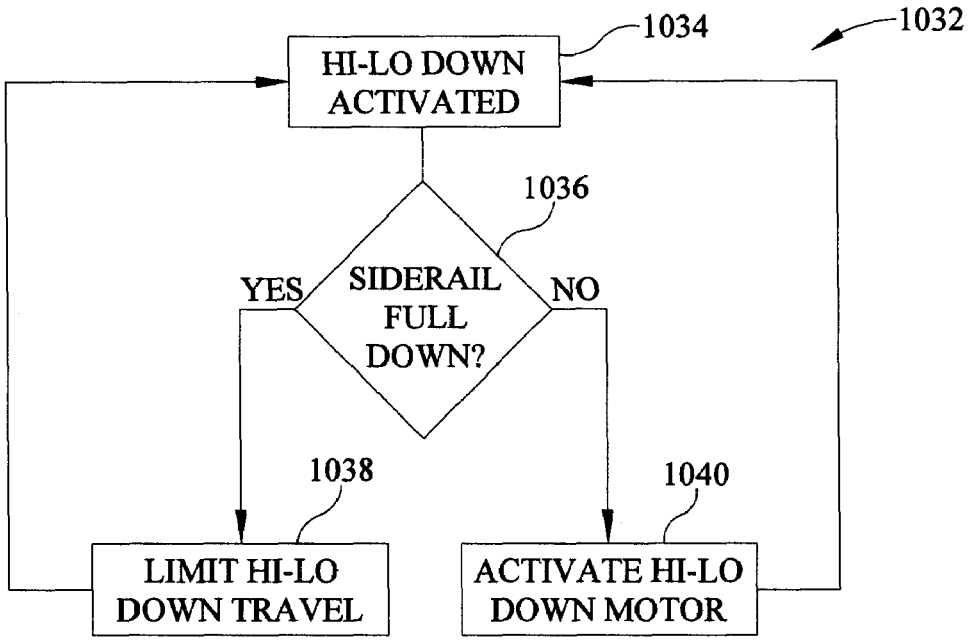
FIG. 24 is a block diagram of a control routine for limiting the travel of the hi-lo of a patient-support apparatus is a siderail is in a down position.
Figure 25:
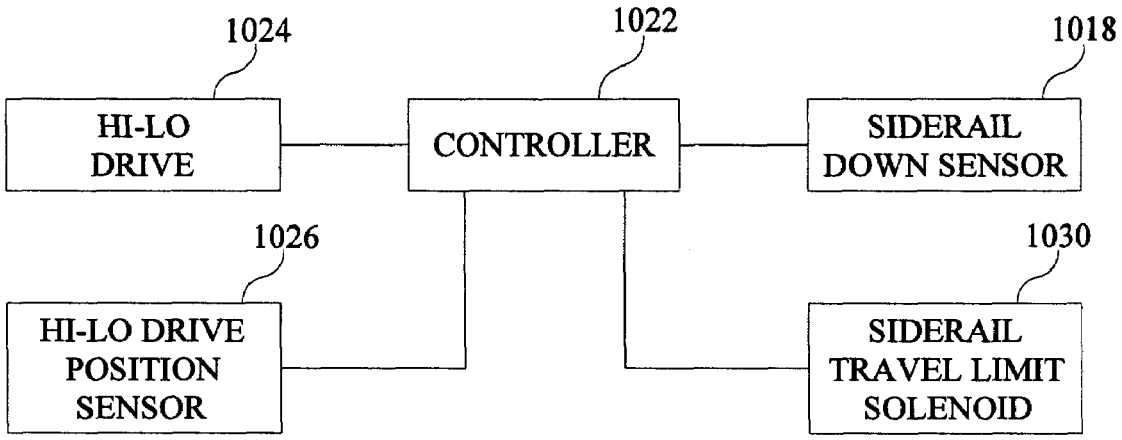
FIG. 25 is a block diagram of a portion of a control system for a patient-support apparatus.

Referring now to FIG. 21, another embodiment of a link mechanism 1000 is similar to the illustrative embodiment of link mechanism 684, but further includes a solenoid 1010 coupled to a second outer plate 1728. Outer plate 1728 includes a through-hole 1020 through which a pin 1012 moves between a retracted position and an extended position shown in FIG. 21. When the solenoid 1010 is energized, pin 1012 extends to engage link 698 to limit the travel of link 698 and thereby limit the distance which a panel 682 travels vertically. When solenoid 1010 is de-energized, as represented in FIG. 23, link 1728 and thereby panel 682 is allowed to lower completely.

Link mechanism 1000 further includes a limit switch assembly 1018 that senses when link mechanism 1000 is in the full down position. Limit switch assembly is coupled to a controller 1022. Controller 1022 is operable to determine that the limit switch assembly 1018 has been made. Controller 1022 is also coupled to the hi-lo drive 1024 and a hi-lo drive position sensor 1026. If the link mechanism 1000 is in the full down position, the controller 1022 is operable to limit the travel of the hi-lo drive 1024 so there is no interference between the hospital bed 22 frame and siderail or with the floor. A control routine 1032 is applied by the controller 1022 to control operation of the hospital bed 22. Upon hi-lo down activation at step 1034, control routine 1032 advances to step 1036 where the position of the siderail is evaluated. If the siderail is in the full down position as measured by limit switch assembly 1018, then control routine 1032 advances to step 1038 where the travel of the hi-lo drive 1024 to a low position that is high enough to prevent accidental interference between portions of the hospital bed 22. If the siderail is determined not to be in the full down position at step 1036, then the control routine 1032 advances to step 1040 and the hi-lo drive 1024 is permitted to be lowered.

Figure 26:
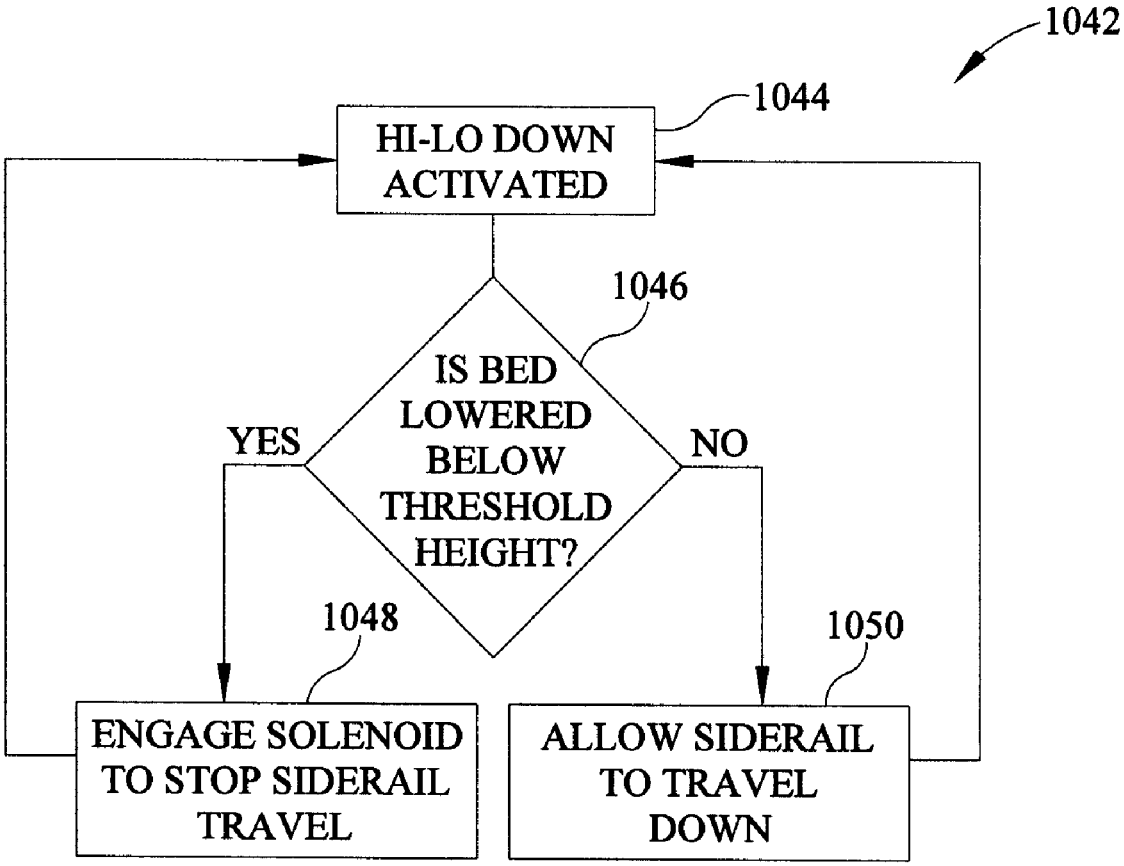
FIG. 26 is a block diagram of a control routine for limiting the travel of the a siderail of a patient-support apparatus if the hi-lo of the patient-support apparatus is lowered than a threshold height.

The travel limit solenoid 1010 also communicates with the controller 1022. If the position of the hi-lo drive 1024 is below a threshold level, then solenoid 1010 is energized to prevent the lowering of the link mechanism 1000 below a level which allows an interference condition to occur. Controller 1022 implements a control routine 1042 as shown in FIG. 26 to make the determination to energize the solenoid 1010. If it is determined that the bed is lower than an acceptable threshold height at step 1046, then control routine 1042 energizes the solenoid 1010 to limit the downward travel of the link mechanism 1000. If the determination is that the bed is not below the threshold at step 1046, then the solenoid 1010 remains unenergized and the siderail is permitted to be lowered.

Figure 27:
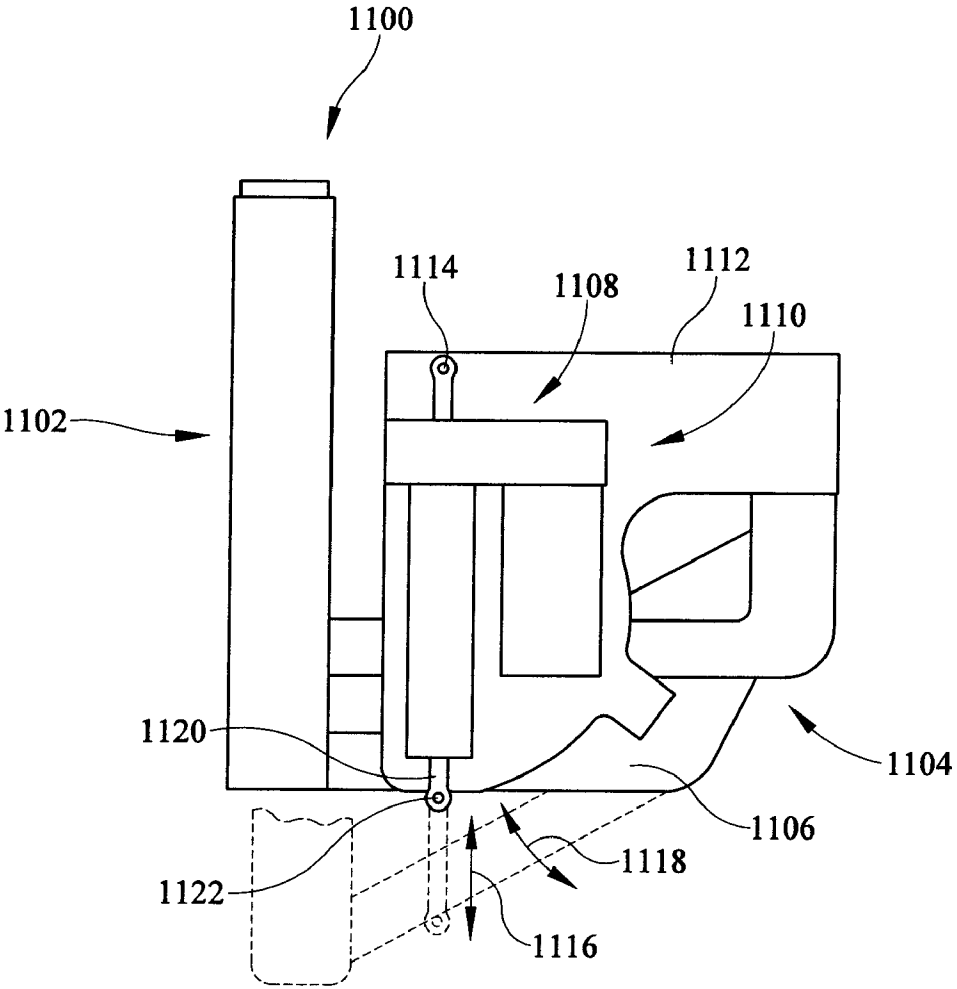
FIG. 27 is a side view of a siderail having an adjustable stop to adjust the height to which a siderail may be lowered.

Another embodiment of siderail 1100 includes a panel 1102, a link mechanism 1104 including a link 1106, and an adjustable stop 1008. Link mechanism 1100 is similar to link mechanism 1000, but adjustable stop 1108 engages link 1106 to limit the downward travel of siderail 1100. Adjustable stop 1108 includes an actuator 1110 having an extensible rod 1120 which extends and retracts as suggested by arrow 1116. A stop pin 1122 is coupled to the extensible rod 1120 and engages the bottom of link 1106. Actuator 1110 is coupled to a frame 1112 of link mechanism 1104 such that extensible rod 1120 extends and retracts relative to frame 1112. Extensible rod 1120 is in a retracted position as shown in solid in FIG. 27. Extension of extensible rod 1120 vertically lowers stop pin 1122 relative to frame 1112. When stop pin 1112 is lowered, link 1106 is allowed to swing lower as suggested by arrow 1118. Thus, adjustment of the position of stop pin 1122 thereby adjusts the lowest position attainable by link 1106. It should be understood that actuator 1110 may include a position sensor capable of providing feedback to a controller such that the position of stop pin 1122 may be adjusted based on the position of various portions of patient support apparatus on which siderail 1100 is mounted.

Figure 28:
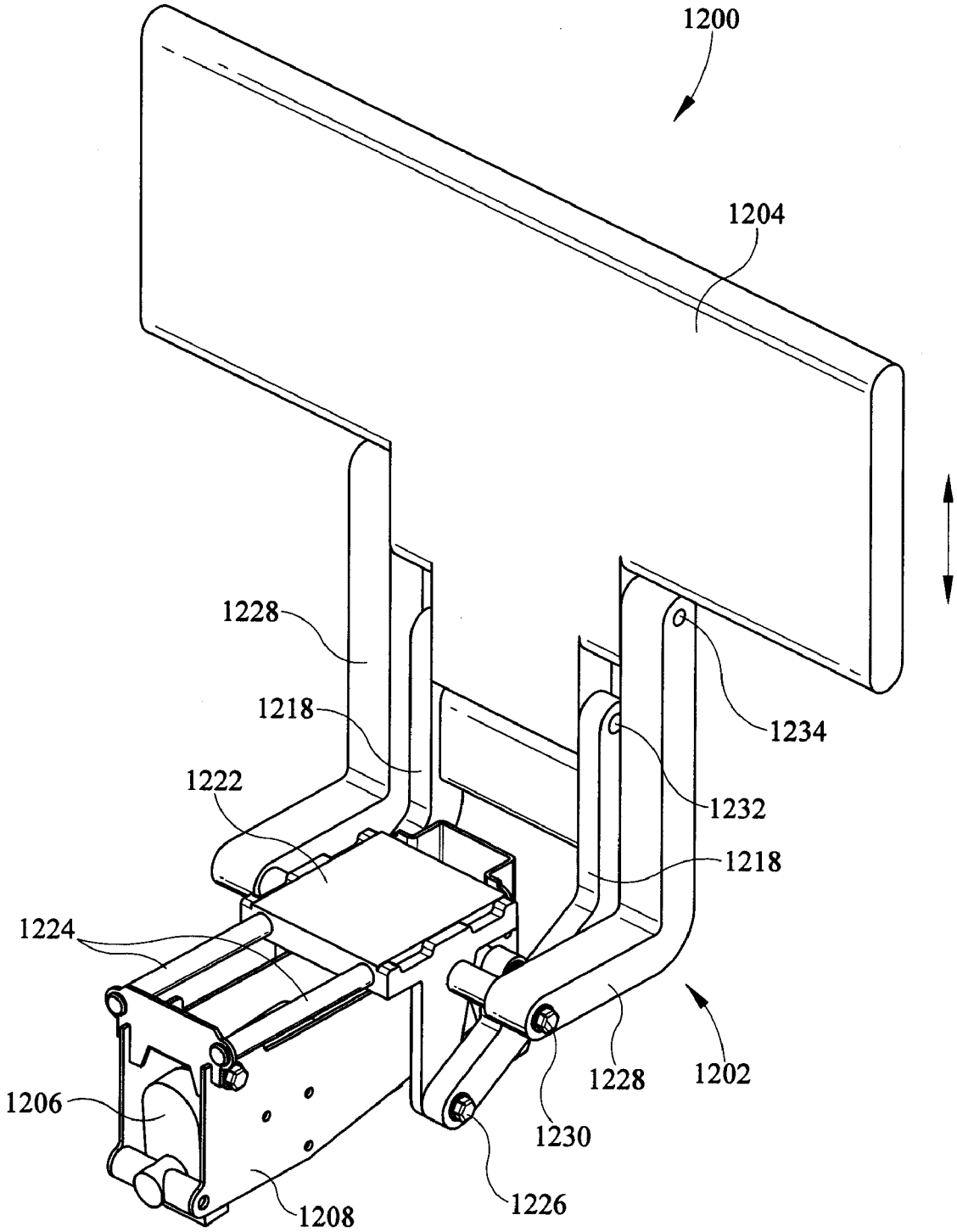
FIG. 28 is perspective view of a powered siderail.
Figure 29:
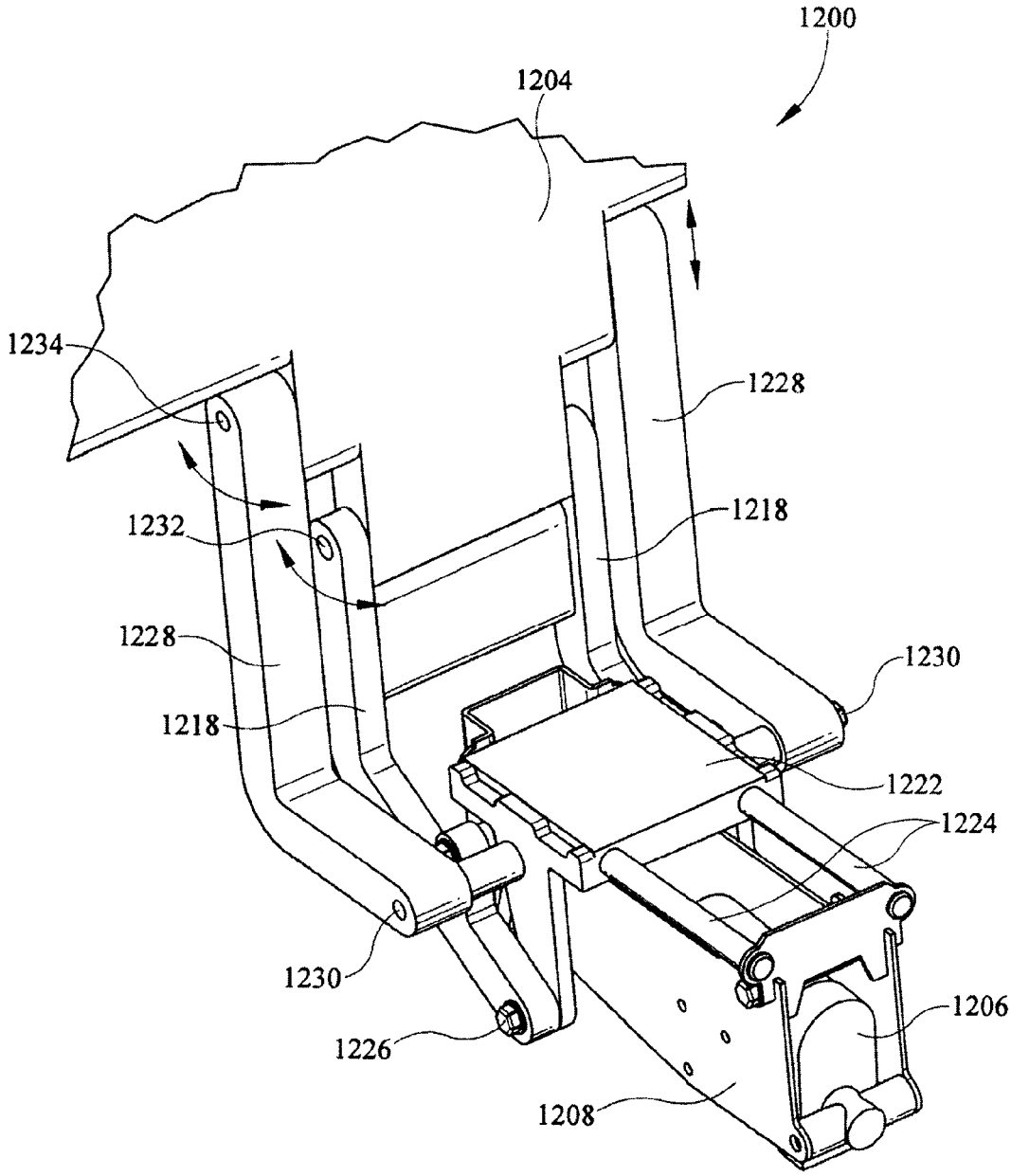
FIG. 29 is another view of the powered siderail of FIG. 28.
Figure 30:
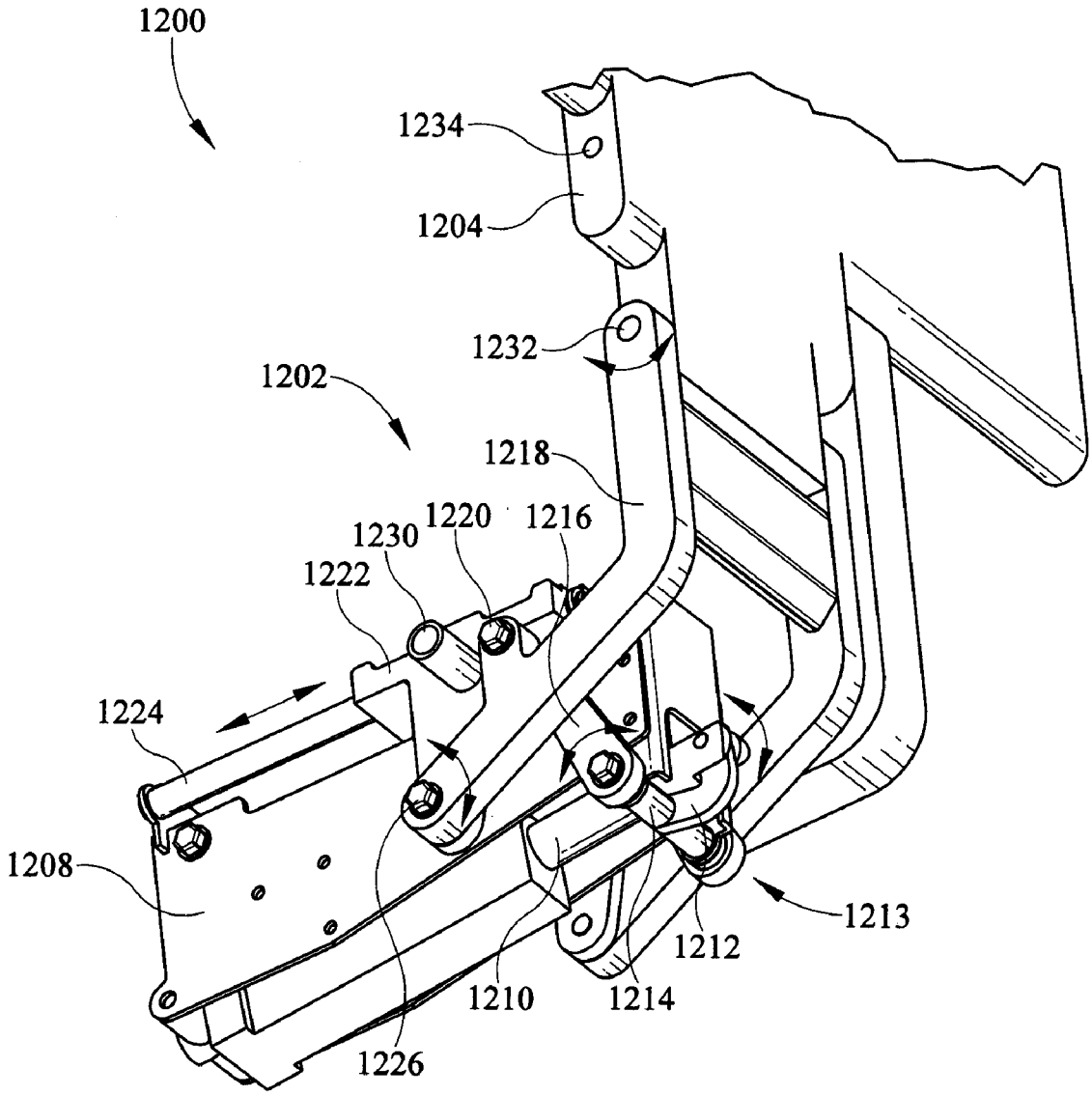
FIG. 30 is another view of the powered siderail of FIG. 28 with portions removed.

In yet another embodiment of siderail 1200 shown in FIGS. 28-30, the position of a link mechanism 1202 and thereby a panel 1204 coupled to the link mechanism 1202 is controlled by a drive 1206. Drive 1206 is movable through a range of positions to raise and lower siderail 1200. Drive 1206 includes and extensible rod 1210 which is pivotably coupled to a bracket 1212 of drive arm assembly 1213. Drive arm assembly 1213 includes a cross-bar 1214 which is pivotably coupled to frame 1208. In addition, drive arm assembly 1213 further includes a pair of links 1216 positioned on either side of frame 1208. Extension and retraction of drive 1206 is transferred through bracket 1212 to cause pivoting of drive arm assembly 1213 about cross-bar 1214 relative to frame 1208.

Links 1216 are pivotably coupled to a pair of links 1218 at a pivot 1220. Links 1218 are pivotably coupled at one end to panel 1204 at pivot 1232. At the opposite end, links 1218 are pivotably coupled to a carriage 1222. Carriage 1222 movable relative to frame 1208 and translates along a pair of rails 1224 coupled to frame 1208. Thus, movement of extensible rod 1210 is transferred through drive arm assembly 1213 to links 1218 which act on carriage 1222.

A second pair of links 1228 act as guides for the motion transferred from drive 1206 to links 1218 to control the movement of panel 1205. Each of the links 1228 is pivotably coupled at one end to carriage 1222 at a pivot 1230. Each of the links 1228 is pivotably coupled to panel 1204 at a pivot 1234 which is at the end opposite pivot 1230. Thus as rod 1210 of drive 1206 extends and retracts, panel 1204 is raised and lowered respectively. In some embodiments, drive 1206 may include a position sensor so that the position of siderail 1200 can be controlled to prevent interference with other portions of the patient support apparatus on which the siderail 1200 is mounted.

Although certain illustrative embodiments have been described in detail above, many embodiments, variations and modifications are possible that are still within the scope and spirit of this disclosure as described herein and as defined in the following claims.

The invention claimed is:

1. A siderail assembly comprising
a frame,
a link mechanism coupled to the frame and movable between first and second positions,
a drive coupled to the frame and coupled to the link mechanism, the drive including an extensible rod which acts on the link mechanism to move the link mechanism between first and second positions, and
a panel coupled to the link mechanism and movable therewith between a first position and a second position.

2. The siderail assembly of claim 1, wherein the link mechanism includes a drive arm assembly pivotably coupled to the frame, a drive link pivotably coupled to the drive arm assembly and pivotably coupled to a carriage, the carriage movable relative to the frame.

3. The siderail assembly of claim 2, wherein the carriage translates relative to the frame.

4. The siderail assembly of claim 3, wherein the frame includes a pair of rails and the carriage translates along the rails.

5. The siderail assembly of claim 4, wherein the link mechanism includes a guide link pivotably coupled to the carriage.

6. The siderail assembly of claim 5, wherein the guide link is pivotably coupled to the panel.

7. The siderail assembly of claim 6, wherein the drive link is coupled to the panel.

8. The siderail assembly of claim 2, wherein the drive arm assembly includes an arm link pivotably coupled to the drive link.

9. The siderail assembly of claim 8, wherein the drive arm assembly includes a cross-bar pivotably coupled to the frame by the arm link.

10. The siderail assembly of claim 9, wherein the drive arm assembly includes a bracket pivotably coupled to the extensible rod.

11. The siderail assembly of claim 10, wherein the bracket is pivotably coupled to the arm link.

12. A siderail assembly comprising
a panel,
a frame,
a carriage slidable relative to the frame,
a drive link pivotably coupled to the panel and to the carriage, and
a drive coupled to the frame, the drive configured to act on the drive link to move the panel between a first position and a second position.

13. The siderail assembly of claim 12, further comprising a guide link pivotably coupled to the panel.

14. The siderail assembly of claim 13, wherein the drive link is pivotably coupled to the panel at a first pivot and the guide link is pivotably coupled to the panel at a second pivot, the second pivot spaced apart from the first pivot.

15. The siderail assembly of claim 14, wherein the guide link is pivotably coupled to the carriage.

16. The siderail assembly of claim 15, wherein the drive link is coupled to the carriage at a third pivot and the guide link is coupled to the carriage at a fourth pivot, the fourth pivot spaced apart from the third pivot.

17. The siderail assembly of claim 16, wherein the drive is configured to act on the drive link to cause the carriage to slide along a rail coupled to the frame.

18. The siderail assembly of claim 12, further comprising a drive arm assembly pivotably coupled to the drive link and configured to transmit movement of the drive to the drive link.

19. The siderail assembly of claim 18, wherein the drive arm assembly includes an arm link pivotably coupled to the drive link at a pivot point located between the ends of the drive link.

20. The siderail of claim 18, wherein movement of the drive link causes the carriage to translate along a rail coupled to the frame.

* * * * *